US012698107B2

(12) United States Patent
Landgraff et al.

(10) Patent No.: US 12,698,107 B2
(45) Date of Patent: Aug. 4, 2026

(54) METHODS AND APPARATUS FOR AUTOMATED COUNTING OF SOLIDS

(71) Applicant: Express Scripts Strategic Development, Inc., St. Louis, MO (US)

(72) Inventors: Izaak T. Landgraff, Brownsburg, IN (US); Joseph A. Siciliano, Zionsville, IN (US)

(73) Assignee: Express Scripts Strategic Development, Inc., St. Louis, MO (US)

( * ) Notice: Subject to any disclaimer, the term of this patent is extended or adjusted under 35 U.S.C. 154(b) by 1000 days.

(21) Appl. No.: 17/941,300

(22) Filed: Sep. 9, 2022

(65) Prior Publication Data

US 2024/0083608 A1 Mar. 14, 2024

(51) Int. Cl.
*B65B 1/08* (2006.01)
*B65B 1/30* (2006.01)

(52) U.S. Cl.
CPC . *B65B 1/08* (2013.01); *B65B 1/30* (2013.01)

(58) Field of Classification Search
CPC ..... B65B 1/08
See application file for complete search history.

(56) References Cited

U.S. PATENT DOCUMENTS 5,473,703 A 12/1995 Smith
8,267,755 B2 9/2012 Adams
8,360,270 B1 * 1/2013 McClosky ..... G07F 11/44 221/202
9,132,429 B2 9/2015 Greve
9,407,800 B2 8/2016 Tsuchiya
9,535,678 B2 1/2017 Warren
9,765,903 B2 9/2017 Kress
9,859,185 B2 1/2018 Tomie
9,957,738 B2 5/2018 Muramatsu
10,174,460 B2 1/2019 Hunold
10,421,227 B2 9/2019 Kalish
10,550,901 B2 2/2020 Tomoki
2002/0179619 A1 12/2002 Geltser
2012/0006843 A1 1/2012 Kim
2013/0284755 A1 * 10/2013 Yuyama ..... A61J 7/02 221/277
2013/0320033 A1 * 12/2013 Brug ..... B65B 35/08 221/265
2015/0129603 A1 * 5/2015 Koike ..... A61J 7/0084 221/13
2016/0167866 A1 * 6/2016 Omura ..... B65B 35/06 221/173
2020/0317382 A1 * 10/2020 Savoie-Lavigueur .... B65B 1/30

* cited by examiner

*Primary Examiner* — Gene O Crawford
*Assistant Examiner* — Ayodeji T Ojofeitimi

(57) ABSTRACT

A shim for a solid counting device is provided. The shim includes: a first end, including a first width and a projection extending in a lateral direction; a second end, including a second width greater than the first width; and an elongated body extending in a longitudinal dimension from the first end to the second end. The first width, the second width, and the projection configured to prevent more than one of a plurality of solids simultaneously traveling into an exit channel of the solid counting device.

30 Claims, 17 Drawing Sheets

METHODS AND APPARATUS FOR AUTOMATED COUNTING OF SOLIDS

TECHNICAL FIELD

Embodiments of the subject matter described herein relate generally to handling medications in a pharmacy fulfillment environment. More particularly, embodiments of the subject matter relate to using automated and/or semi-automated tools to fill prescriptions and prescription orders in a high-volume pharmacy fulfillment environment.

BACKGROUND

A high-volume pharmacy may process and fill many prescriptions and prescription orders. The accuracy and efficiency in which these systems distribute medications can be important for the pharmacies. Although demand for the services provided by a pharmacy may be high, constraints associated with, and specific to, a particular pharmacy can limit a quantity of prescription orders filled by that pharmacy. Such constraints may include time constraints, capacity constraints, personnel constraints, or the like. Systems automation may be integrated and used by a high-volume pharmacy to mitigate effects of the constraints on pharmacy productivity levels and to increase efficiency in processing and fulfilling prescriptions. Generally, such automation introduces increased speed and efficiency in filling prescriptions by reducing or eliminating one or more aspects of human intervention in the prescription filling procedure.

However, as systems automation reduces human participation, certain quality controls may be indirectly reduced. For example, a human pharmacy employee can incorporate "double-checking" verification steps while performing identification and packaging tasks associated with prescription fulfillment. Such verification may be performed simply by having his or her eyes on the medication and any measuring instrumentation as the prescription is being filled. In contrast, an automated system does not typically incorporate human oversight of every step of the identification, packaging, and distribution process. Although speed and efficiency may be improved by incorporating the systems automation, accuracy may not necessarily be maintained.

Accordingly, it is desirable to incorporate quality controls to ensure that an automated system is performing according to its design. Furthermore, other desirable features and characteristics will become apparent from the subsequent detailed description and the appended claims, taken in conjunction with the accompanying drawings and the foregoing technical field and background.

BRIEF SUMMARY

An apparatus and system are provided for improving operation of a solid counting device, the apparatus and system being operable to alter a physical position of solids such that each solid is spaced apart from other solids as a discrete, individual object.

The above and other aspects may be carried out by an embodiment of a shim for a solid counting device. The shim includes: a first end, including a first width and a projection extending in a lateral direction; a second end, including a second width greater than the first width; and an elongated body extending in a longitudinal dimension from the first end to the second end. The first width, the second width, and the projection are configured to prevent more than one of a plurality of solids simultaneously traveling into an exit channel of the solid counting device.

The above and other aspects may be carried out by an embodiment of a system for counting solids. The system includes a vibratory bowl and a shim. The vibratory bowl includes at least an inner bowl surface and an exit opening. The vibratory bowl is configured to: generate motion of a plurality of solids; and dispense individual ones of the plurality of solids, via the exit opening, for counting the plurality of solids. The shim is positioned inside an exit channel extending from the exit opening of the vibratory bowl. The shim includes: a first end, including a first width and a projection extending in a lateral direction; a second end, including a second width greater than the first width; and an elongated body extending in a longitudinal dimension from the first end to the second end. The first width, the second with, and the projection of the shim are configured to prevent more than one of the plurality of solids simultaneously traveling into an exit channel of the vibratory bowl.

A method is provided for use of an apparatus for improving operation of a solid counting device, the apparatus being operable to alter a physical position of solids such that each solid is spaced apart from other solids as a discrete, individual object. The term "spaced apart" indicates a gap between adjacent solids and the absence of physical contact between the solids.

The above and other aspects may be carried out by an embodiment of a method for counting solids using a solid counting device. The method includes: receiving a plurality of solids to be counted, by a vibratory bowl comprising at least an inner bowl surface, an exit opening, and a channel extending from the exit opening around an edge of the vibratory bowl; generating motion to shuffle the plurality of solids toward the channel, by the vibratory bowl; separating one of the plurality of solids entering the channel connected to the exit opening, by a shim comprising an elongated body narrowing from a second end to a first end having a projection extending in a lateral direction, the shim being positioned in the channel; and dispensing the one of the plurality of solids via the exit opening, using the motion, the channel, and the shim.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1A:
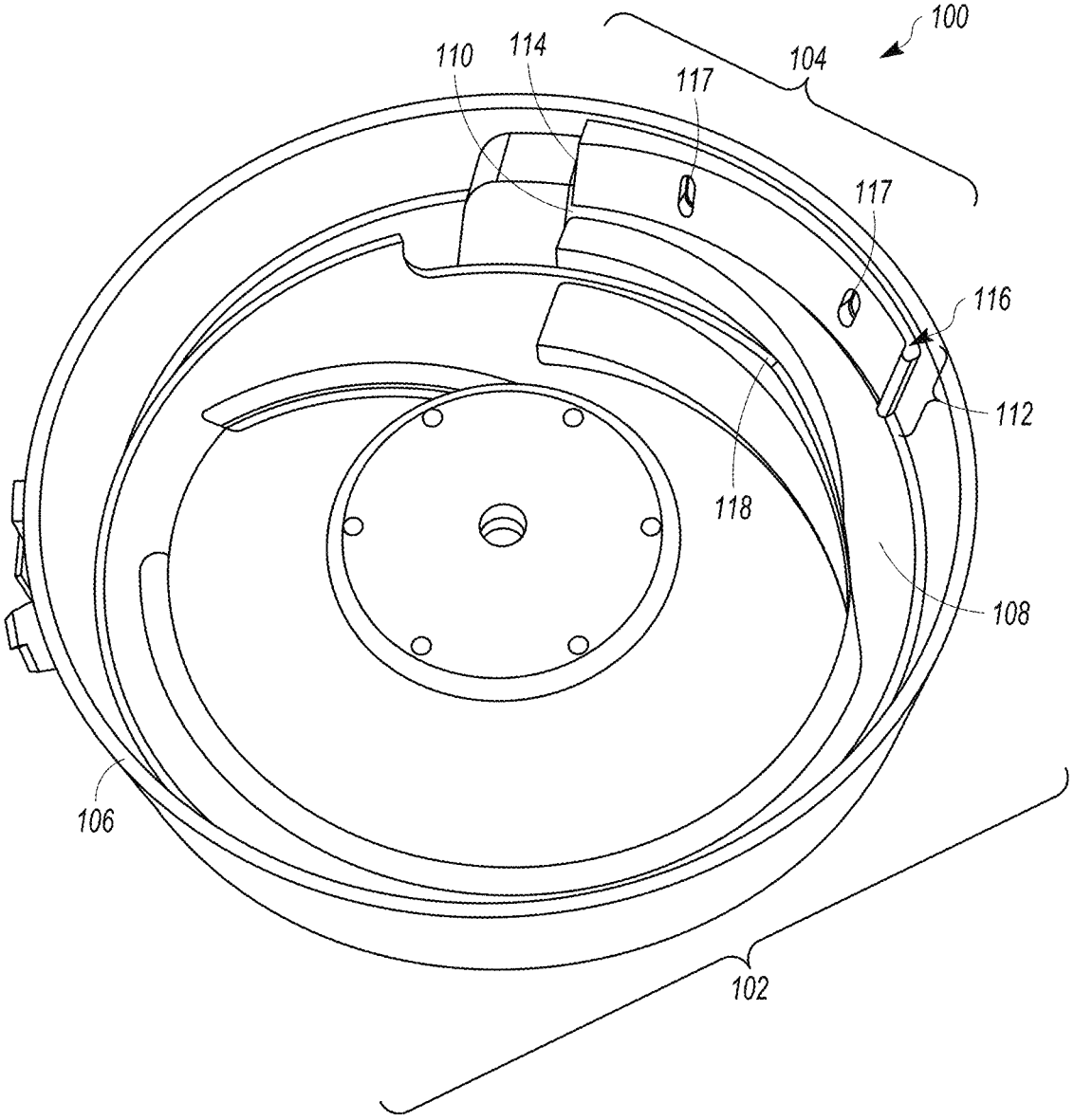
FIGS. 1A-1B are diagrams of a part of a solid counting device, in accordance with the disclosed embodiments.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

The subject matter presented herein relates to apparatus and methods for using automated or semi-automated equipment to count solids in a pharmacy fulfillment environment, where the solids may include any type of medication in the form of discrete, countable pieces. More specifically, the subject matter relates to the installation and use of a shim inside a discrete object counter to facilitate accurate counting. In an example, the shim may be configured to singulate a solid from adjacent solids, i.e., producing a gap between the solids. Counting the solids during packaging ensures that an appropriate quantity of solids are included in a prescription bottle or container. Using an automated or semi-automated process to count the solids, as described herein, provides a quality control verification process prior to distribution and/or shipping of the prescription container. The automated or semi-automated counting of prescription drug solids also provides an added layer of protection for the pharmacy fulfillment center in cases of prescription medications subject to increased level of regulatory control.

Certain terminologies are used with regard to the various embodiments of the present disclosure. Typically, discrete, countable pieces of medication may include pills, tablets, capsules, chewable solids, "gummy" medication, and/or any type of medication encased in a firm coating to create a solid form (e.g., gel-caps, gel-tabs, liquid capsules). The solid form is not a liquid or fluid. The counting can be for a plurality of solids having a same shape, a same volume, and/or a same mass. It should be appreciated that other types of discrete solids may be counted as part of the embodiments described herein. For purposes of the present disclosure, the discrete, countable pieces of medication may be referred to as solids, medication solids, discrete objects, or discrete pieces, or the like. It should also be appreciated that any naming convention may be used, without departing from the scope of the present disclosure.

Automated processes typically include steps or actions performed using machinery and/or computing equipment without (or with minimal) human participation. Semi-automated processes may include a combination of automated steps or actions and steps requiring human intervention. For purposes of the present disclosure, solid counting processes performed in a pharmacy fulfillment environment may be automated or semi-automated without departing from the scope of the embodiments described herein.

Figure 1B:
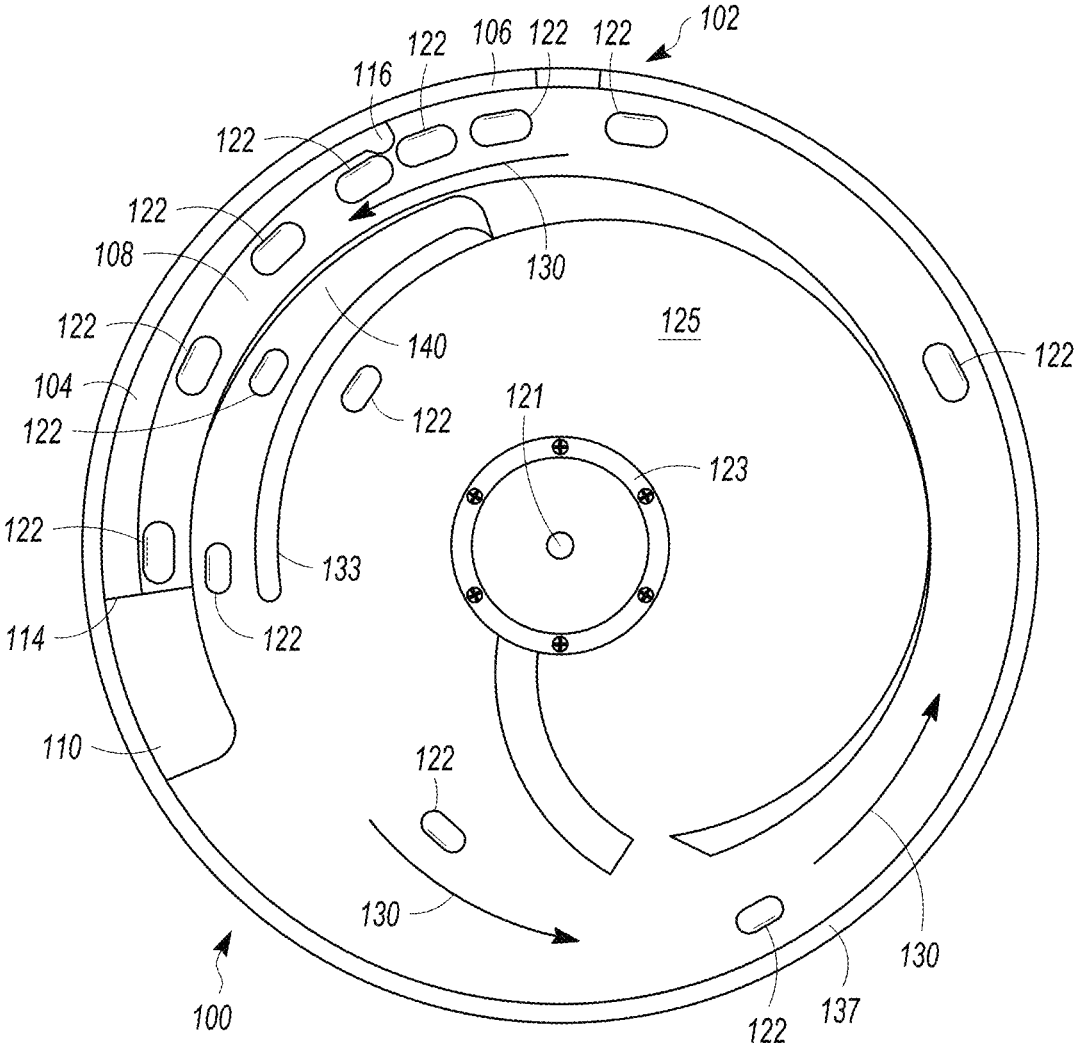

Turning now to the figures, FIGS. 1A and 1B is a diagram of a solid counting device 100, in accordance with the disclosed embodiments. As shown the solid counting device 100 includes, without limitation: a vibratory bowl 102 and a shim 104. It should be appreciated that FIGS. 1A and 1B depicts a simplified embodiment of the solid counting device 100, and that some implementations of the solid counting device 100 may include additional or alternative elements or components, as desired for the particular application. For example, additional components such as input and/or output devices appropriate for use with discrete solids 122 in a pharmacy fulfillment center (e.g., ramps, chutes, tubes), components appropriate for machine automation (e.g., robotic or otherwise automated machinery), computing equipment, displays, user input components, or the like may be employed without departing from the scope of the present disclosure. Elements and features of the solid counting device 100 may be operatively associated with one another, coupled to one another, or otherwise configured to cooperate with one another as needed to support the desired functionality, as described herein. For ease of illustration and clarity, the various physical, electrical, and logical couplings and interconnections for these elements and features are not depicted in FIGS. 1A and 1B.

The solid counting device 100 is used to perform an automated or semi-automated counting process for solids 122 in a pharmacy fulfillment environment, where the solids 122 may include any type of medication in the form of discrete, countable pieces. Counting the solids 122 during packaging ensures that an appropriate quantity of solids 122 are included in a prescription bottle or container. Accuracy of the count may be improved when a multitude of discrete, countable pieces are separated by at least one physical gap. For example, a plurality of solids 122 may be positioned separately in a line with a gap between each of the countable pieces. The solid counting device 100 includes a vibratory bowl 102 and a shim 104.

The vibratory bowl 102 is operable to generate motion of a plurality of solids 122 inside the vibratory bowl 102, toward an exit opening 110, resulting in dispensing individual ones of the plurality of solids 122 via the exit opening 110, for counting purposes. The vibratory bowl 102 includes an exit opening 110 and an exit channel 108 extending from the exit opening 110 along an edge 106 of the vibratory bowl 102. During typical operation, the motion generated by the vibratory bowl 102 shuffles solids 122 resting on an inner bowl surface of the vibratory bowl 102 such that a subset of the solids 122 moves into the exit channel 108 at the edge 106 of the vibratory bowl 102.

Certain embodiments of the exit channel 108 may be in the shape of a ramp or chute, using a raised channel edge 118 and the edge 106 of the vibratory bowl 102 as the sides of the exit channel 108 (i.e., the edges 118, 106 are used as the sides of the chute). The exit channel 108 extends around the vibratory bowl 102, along the edge 106, and terminates at the exit opening 110. In practice, the motion of the vibratory bowl 102 moves the solids 122 into the exit channel 108, through the exit channel 108, and out of the exit opening 110 to be counted. Exemplary embodiments of the solid counting device 100 use the motion generated by the vibratory bowl 102 to position each of the solids 122 into a single-file line traveling through the exit channel 108, out of the exit opening 110, and into an automated counting mechanism.

The automated counting mechanism is operable to obtain and provide a total number of the discrete solid objects 122 that have been received by the vibratory bowl 102, moved using the generated motion, and separated using the shim 104 to introduce gaps between individual solids 122. Counting occurs after each solid 122 leaves the vibratory bowl 102 by traveling through the exit opening 110.

The automated counting mechanism may be implemented using any sensor-based object detection tool in combination with a counter. Certain embodiments of the solid counting device 100 increment a counter each time a discrete solid object 122 is detected. Typical embodiments of the solid counting system 100 perform object detection using one or more optical sensors. As one example, the solid counting system 100 may use an array of photoelectric sensors operating cooperatively with a plurality of light beams (e.g., a light curtain or a light grid). In this example, an array of photoelectric sensors is operable to detect (i) projection of the light beams, and (ii) interruption or shadowing of one or more of the light beams as a result of a discrete solid object 122 blocking the light. Object detection is performed using this light interruption or shadowing, which indicates the presence of the discrete solid object 122. Although exemplary embodiments of the solid counting system 100 use optical sensors to perform object detection, it should be appreciated that any object detection sensor suitable for pharmaceuticals may be used. For example, the solid counting system 100 may use any type of electromechanical sensors, ultrasonic sensors, or the like.

However, the motion generated by the vibratory bowl 102 may cause more than one discrete solid 122 to enter the exit channel 108 and to pass through the exit opening 110, at the same time, thereby hindering the counting process. In other words, an accurate count may not be obtained when two or more discrete solids 122 pass through the exit channel 108 and exit opening 110 simultaneously, or essentially simultaneously. In this scenario, the two or more solids 122 may not be perceived as discrete by the automated or semi-automated solid counting device 100, and instead may be perceived and counted as one individual object 122. Thus, separation between the solids 122 is needed to ensure performance of an accurate count.

To achieve the separation between discrete solids 122 in a solid counting device 100, a shim 104 is used in combination with the vibratory bowl 102. The shim 104 is positioned inside the vibratory bowl 102 and is operable to provide separation between the discrete solids 122 being counted. As shown, the shim 104 is positioned inside the exit channel 108 of the vibratory bowl 102, to prevent the more than one of the plurality of solids 122 from traveling up the exit channel 108 simultaneously such that only one solid 122 enters the exit opening at a time. The shim 104 includes an outer convex surface positioned adjacent to an inner surface of the vibratory bowl 102, and the projection 116 extends outward from an inner concave surface of the shim 104, wherein the inner concave surface is positioned to contact the plurality of solids 122 to be counted. In certain embodiments, the shim 104 is secured to the inner surface of the vibratory bowl 102, via one or more fastener openings 117, using a fastener or fastener device, such as a bolt, a clamp, or the like. It should be appreciated that the shim 104 may include fastener openings 117 of any size applicable to any particular fastener. In addition, although the embodiment shown includes two fastener openings 117, other embodiments of the shim 104 may include any number of fastener openings 117, as needed for a particular application. The fastener openings 117 are positioned such that openings and fasteners will not contact the solids 122 traveling along the ramp and in contact with shim 104. In an example, the fastener openings 117 are at a height greater than the height of the solid 122. In an example, the fastener openings 117 are at a height greater than the largest dimension the solid 122.

The shim 104 includes a first end 112, a second end 114, and a projection 116. The shim 104 is typically an elongated body, narrowing from a wider second end 114 to a narrower first end 112 that includes a projection 116 extending laterally (or radially relative to the vibratory bowl 102) into the exit channel 108. The exit channel 108 is wide enough at the projection 116 such that a single solid 122 can travel over the projection and remain on the exit channel. Some embodiments of the shim 104 may include an additional projection spaced from the projection 116 in a direction of travel of a discrete solid 122 in the exit channel 108 (i.e., on the ramp, in the chute). In an example, two or more projections are positioned along the length of the shim. Each of the projections extend into the space along the ramp. Hence, the plurality of projections operate to singulate the solids 122 in more than one location along the exit channel.

The width of the first end 112, the width of the second end 114, and the projection 116 are configured to prevent more than one of a plurality of solids 122 from simultaneously traveling into the exit channel 108 of the solid counting device 100. In other words, the shape, dimensions (e.g., length, widths at ends), features (e.g., the projection 116), and positioning of the shim 104 are operable to permit one discrete solid 122 to enter the exit channel 108 at a time and to prevent additional ones of the discrete solids 122 from entering the exit channel 108 at the same time. In an example, the projection 116 operates to spatially separate solids 122 that are already traveling on the exit channel 108. Thus, the shape, dimensions, features, and positioning of the shim 104 are operable to provide separation (e.g., gaps, which can be at least half a dimension of an individual solid 122) between discrete objects 122 to facilitate accurate counting of the separated discrete objects 122.

FIG. 1B shows direction of travel of the solids 122 in the vibratory bowl 102 via the arrows. The vibratory bowl 102 rotationally vibrates about its center axis 121. A guard wall 123 surrounds the center axis to prevent the solids 122 from coming into contact with the center axis 121. A prime mover, under control from an electronic control circuitry, vibrates the bowl 102. In operation, numerous solids 122 are poured into the center volume 125 of the bowl 102. The bowl 102 vibrates to cause the solids 122 to move in a counter clockwise direction, see arrows in FIG. 1B. The bowl vibration can be a faster rotation in the direction of travel as indicated by arrows 130 (here counter clockwise) than in the opposite direction. The bowl vibration can be a longer rotation in the direction of travel as indicated by arrows 130 (here counter clockwise) than in the opposite direction. This can cause the solids 122 to travel in the direction 130. The solids 122 travel from the center volume around the guard wall 123 and cannot travel radially outwardly past the center arcuate wall 133. A feeder wall 135 extends from the axis guard wall 123 to the outer wall 137 adjacent the start 139 of the ramp 108. The solids 122, upon action of the motion of the bowl 102, travel along the ramp 108 adjacent the outer wall 137. The solids 122 may be touching each other, stacked on each other, not have a gap between successive solids 122, or a combination of these when traveling on the ramp until the solids 122 come into contact with the gap-producing protrusion 116. The ramp 108 creates a single file line of solids 122 be being upraised above the center volume 125 such that solids 122 can fall inwardly off the ramp back into the center volume 125. The solids 122 contact the protrusion 116 and must overcome its dimension in the radial direction to continue to move along the ramp 108. If solids 122 are side-by-side in the radial direction the protrusion 116 will force the inner solid off the ramp and into the exit area 140 that will feed the solid back into the center volume 125. The solids 122 overcome the protrusion 116 to continue travelling on the ramp 108 but now have a gap between adjacent solids 122. As discussed herein, this gap results in a single solid 122 falling through the exit opening 110 into the counting mechanism under the bowl 102.

FIGS. 2A-2E are diagrams of various views of a shim 204 for use with a solid counting device, in accordance with the disclosed embodiments. The various views include orthogonal projections of the shim 204 using different reference planes (e.g., horizontal plane, vertical plane, profile plane). It should be noted that the shim 204 can be implemented with the shim 104 depicted in FIG. 1. In this regard, the shim 204 shows certain aspects and features of the shim 104 in more detail.

Figure 2A:
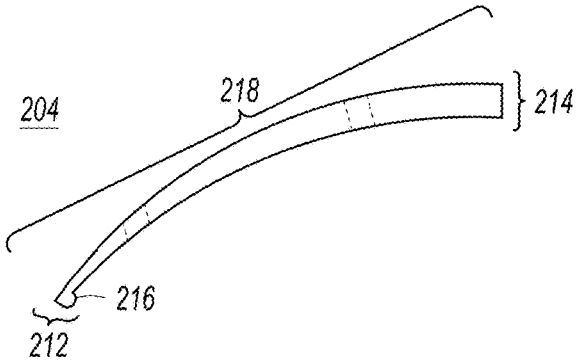
FIGS. 2A-2E are diagrams of a shim for use with a solid counting device, in accordance with the disclosed embodiments.

FIG. 2A is a top view of the shim 204, projected on a horizontal plane. As shown, the shim 204 includes a first end 212, a second end 214, and a longitudinal dimension 218 extending from the first end 212 to the second end 214. The longitudinal dimension 218 extends from the first end 212 to the second end 214, and the longitudinal dimension 218 narrows from the second end 214 to the first end 212. The first end 212 includes a first width and a projection 216 extending in a lateral direction. The second end 214 includes a second width greater than the first width. Typically, the first width and the second width are proportional values associated with particular types of a solid to be counted.

The second width 214 is generally positioned at an exit opening of a vibratory bowl (references 110 and 102 of FIG. 1), and the second width 214 is configured to permit only one discrete solid object to pass through the exit opening. In other words, the second width 214 provides a partial obstruction to the exit opening to permit one and only one discrete solid object to pass through the exit opening at a time, and to prevent the simultaneous passage of multiple discrete solid object through the exit opening. Due to variations in size and shape of discrete solid objects, the second width 214 may also require variations to permit different sizes or shapes to pass through the exit opening. Thus, embodiments of the shim 204 may be implemented in different sizes to accommodate sizes of various types of solids and/or sizes of various specific solids.

In certain embodiments, the width of the first end 212 (i.e., the first width) may be a width of the projection 216 extending from the first end 212, the projection width being less than the second width. As one example, the projection 216 may be a cylindrical shape, the projection width may be a diameter of the projection 216, and the entirety of the first end 212 may be the cylindrical shape of the projection 216. Therefore, the diameter of the projection is the width of the first end 212. However, in other embodiments, the projection 216 may be joined to a narrow part of the shim 204 to create the first end 212. Here, the first width may be the sum of a projection width and a width of a part of the shim 204 to which the projection is joined.

The projection 216 may be semi-cylindrical with an outer surface that is coincident with an edge of the first end 212. The projection 216 may be semi-cylindrical with a center point that is coincident with an inner surface of the shim 204, as shown in FIG. 2E.

Other embodiments may include a projection 216 with a center point or an outer surface that is not coincident with the inner surface of the shim 204. In this scenario, the projection 216 with a non-coincident center point or outer surface may continue to be located at the first end 212, wherein the center point or the outer surface is offset from the inner surface of the shim 204. Alternatively, the projection 216 with anon-coincident center point or outer surface may be a second projection that is located further away from the first end 212, wherein a first projection is located at the first end 212 and the shim 204 includes at least the first projection and the second projection. In this example, the first projection may include a center point or outer surface that is coincident or non-coincident with the inner surface of the shim 204.

Certain embodiments of the projection 216 may be in the form of a semi-cylindrical shape, as described herein. However, it should be appreciated that the projection 216 may be in the form of an elliptical shape, a saw-tooth shape, and/or any other shape suitable for separating a plurality of discrete solids inside a solid counting device (IG. 1, reference 100).

As described previously with reference to FIG. 1, the shim 204 includes an outer convex surface 220 (for positioning adjacent to an inner surface of a vibratory bowl) and the projection 216 extends outward from an inner concave surface 222 of the shim 204, wherein the inner concave surface 222 is positioned to contact the plurality of solids to be counted. In certain embodiments, the outer convex surface 220 extends along a constant radius, and wherein the inner concave surface 222 extends along an inner radius that shortens from the first end to the second end.

Using the first width, the second width, and the projection, the shim 204 is operable to prevent more than one of a plurality of solids simultaneously traveling into an exit channel of the solid counting device. In other words, the physical characteristics of the shim 204 are used to separate the group of solids into a single file line of solids each separated from each other by a gap, for purposes of counting individual solids and obtaining an accurate total count of the plurality of solids.

Figure 2B:
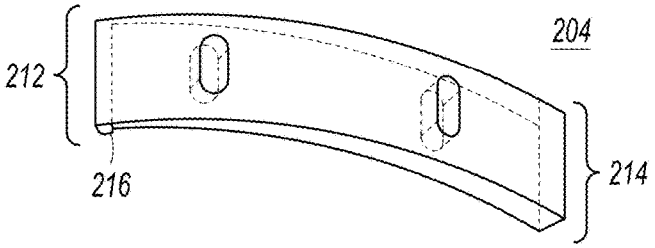

FIG. 2B is an angled view of the shim 204, presenting a front view and a bottom view of the shim 204 The angled view may also be referred to as a three-dimensional projection view, where the shim 204 is presented at an angle such that the viewer sees the top, front, and side of the shim 204 from the line of sight.

In the embodiment shown, the projection 216 is semi-cylindrical and extends an entire height of the body of the shim 204. However, other embodiments of the shim 204 may include a projection 216 extending from a bottom of the shim 204 upward at least a height of the solid. For example, the projection 216 may not extend an entire height of the body of the shim, but instead may extend to a partial shim height. At a minimum, the height of the projection 216 is the height of the solid to be counted, but may be higher, as required for the particular application. Additionally, although some embodiments of the shim 204 include a projection 216 in the form of a semi-cylindrical shape, other embodiments of the shim 204 may include a projection 216 in the form of an elliptical shape, a saw-tooth shape, and/or any other shape adapted to separate discrete solids inside a solid counting device for counting purposes.

Figure 2C:
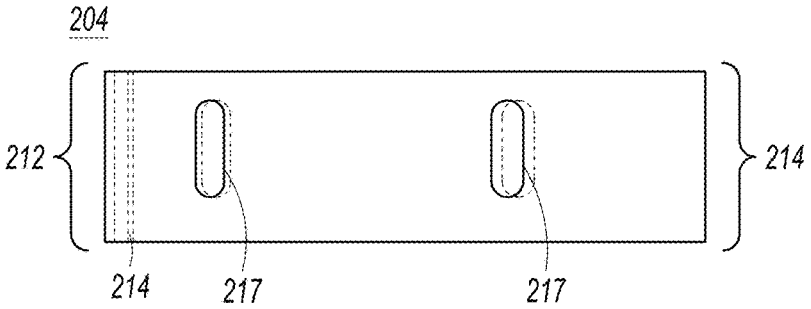

FIG. 2C is a front view of the shim 204, projected onto the vertical plane. The front view may also be referred to as an anterior view, where the shim 204 is presented as if the viewer sees the front of the shim 204 from a line of sight perpendicular to the vertical plane.

In typical embodiments, the shim 204 is an elongated body constructed of any pharmaceutical-grade material, i.e., any material that is inert or non-reactive with pharmaceuticals. Examples may include, but are not limited to, pharmaceutical-grade polymers and/or metals. Embodiments of the shim 204 are typically associated with a shim size, indicating the first width and the second width. A plurality of solids (i.e., solid objects, discrete solid objects) is typically associated with a solid size, indicating one or more of diameter, radius, length, width, and/or any other indication of size of the solid. Size of the solids corresponds to a shim size required to separate and count a plurality of the solids. In other words, a particular shim size may be needed to separate and count a particular solid.

Figure 2D:
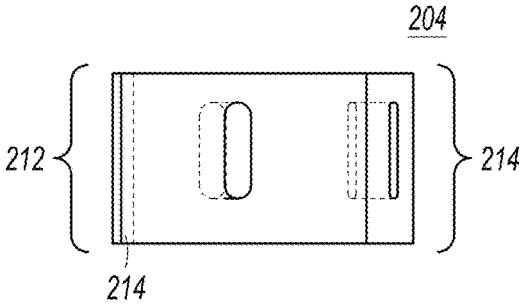
Figure 2E:
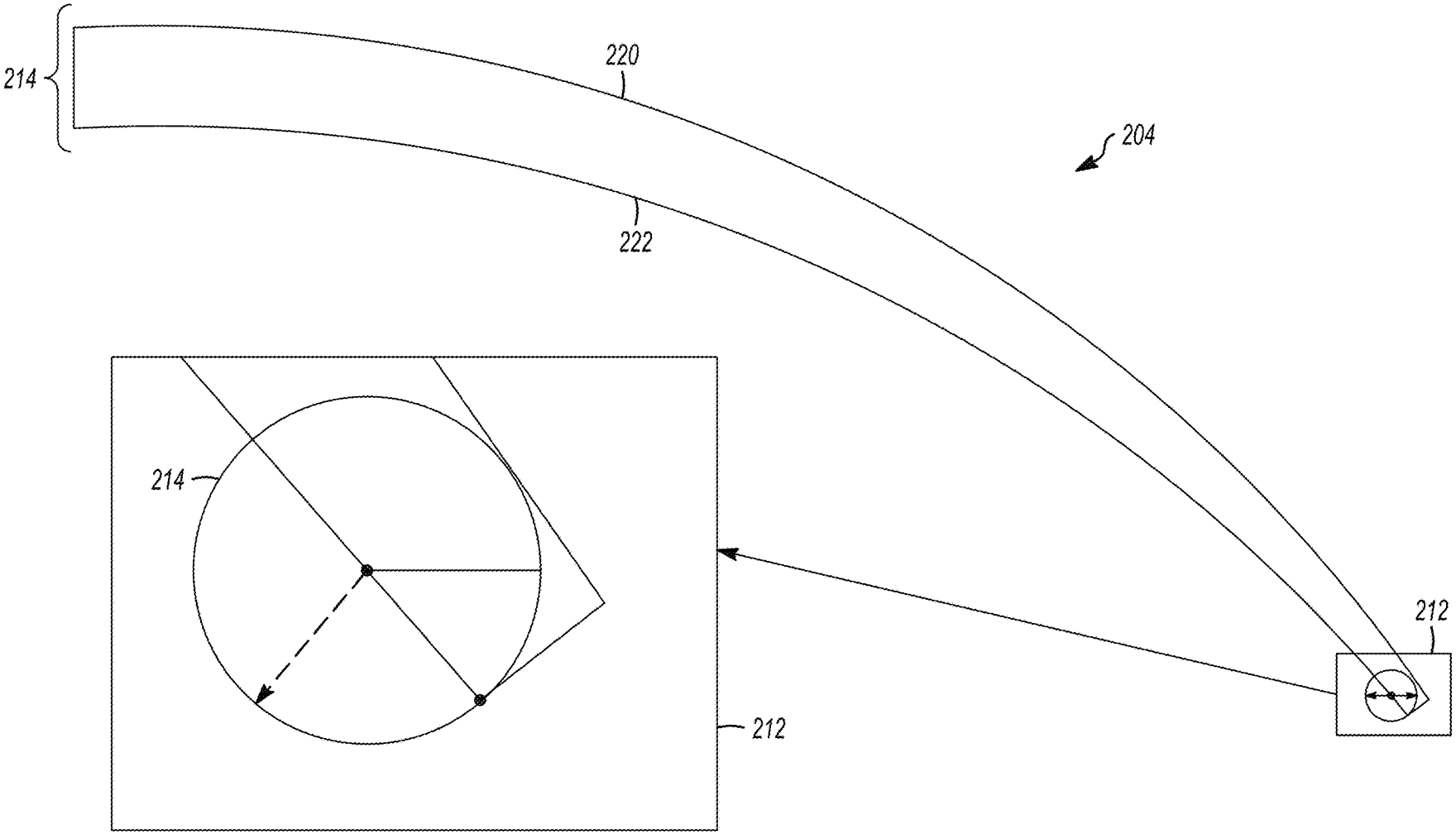

FIG. 2D is a side view of the shim 204, projected onto a profile plane. The side view may also be referred to as a lateral view, where the shim 204 is presented as if the viewer sees the side of the shim 204 from a line of sight perpendicular to the profile plane.

Although FIGS. 2A-2E depict a single projection 216 at the first end 212, in practice one or more additional projections may be used. In some embodiments, the first end 212 may include an additional projection spaced from the projection 216 in a direction of travel of the one of the plurality of solids in the exit channel. Here, the projection 216 and the additional projection are used to separate the discrete solid objects, for counting purposes.

Figure 3A:
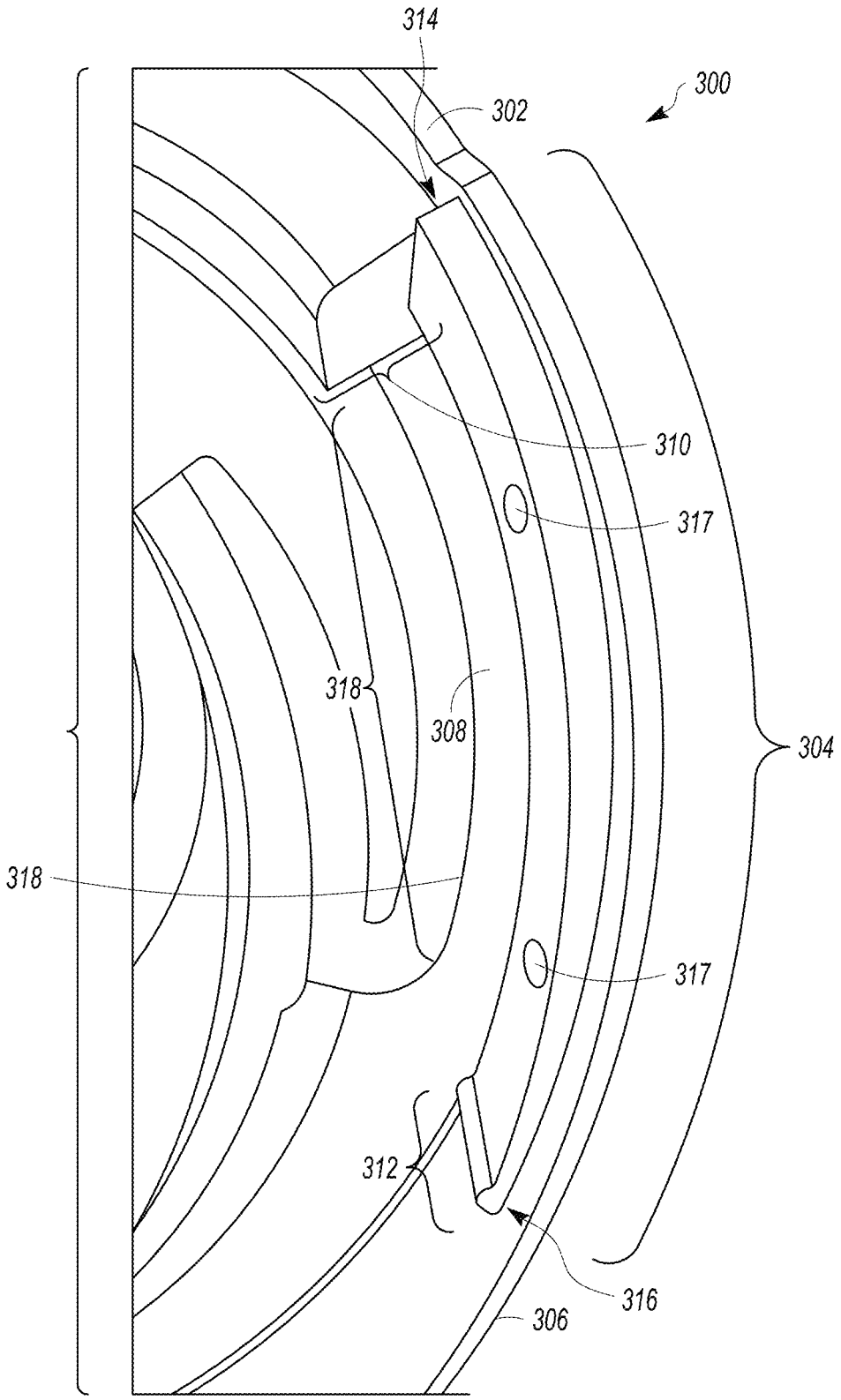
FIGS. 3A-3C are diagrams of primary and/or secondary shims positioned inside a vibratory bowl of a solid counting device, in accordance with the disclosed embodiments.
Figure 3B:
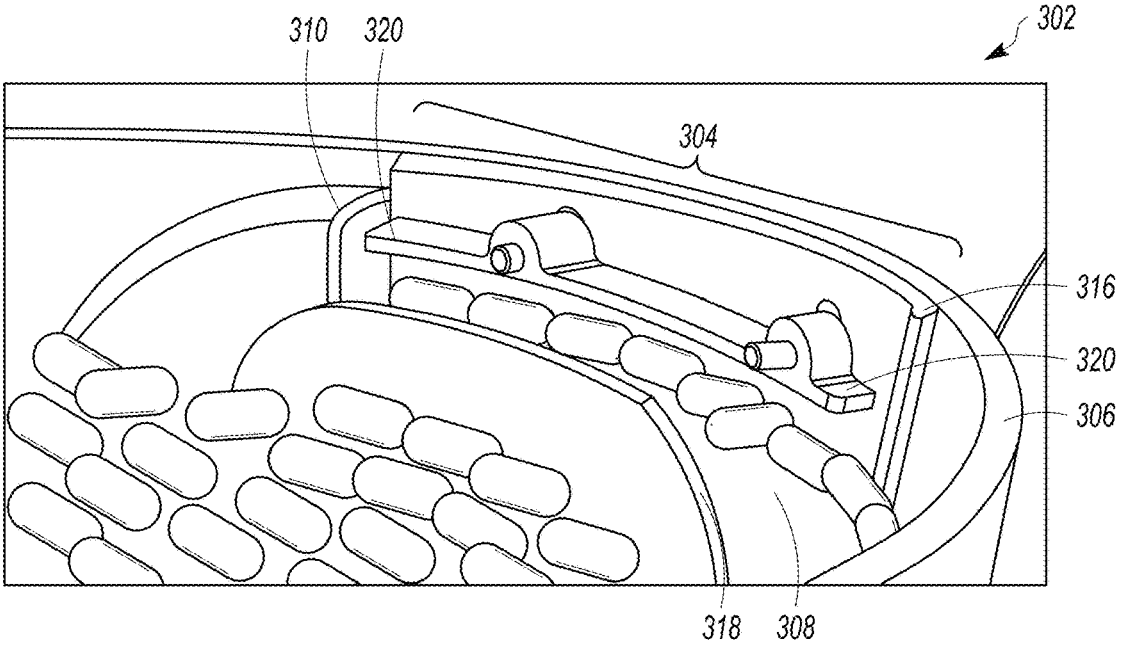

FIGS. 3A-3B are diagrams of a primary shim 304 and a secondary shim 320 positioned inside a vibratory bowl 302 of a solid counting device 300, in accordance with the disclosed embodiments. The primary shim 304 and the secondary shim 320 are used, separately or together, to separate solids (e.g., pills, tablets, or other solids) to ensure that each solid travels alone through the exit opening 310 of the vibratory bowl 302 for counting purposes. Although the primary shim 304 and the secondary shim 320 are both used to separate solids to ensure that each solid is counted individually, the separation is applicable to solids positioned differently. As described herein, the primary shim 304 is adapted to separate solids where one solid is positioned beside another solid (i.e., horizontal separation), and the secondary shim 320 is adapted to separate solids where one solid is positioned on top of another solid (i.e., vertical separation).

Figure 3C:
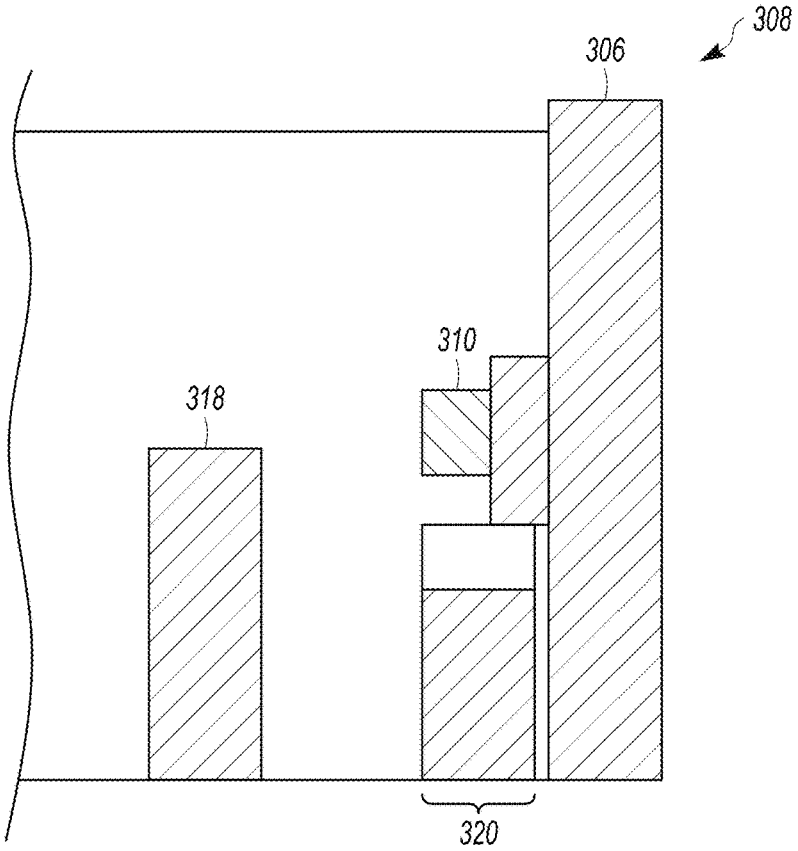

FIG. 3A is a diagram of a shim 304 (i.e., a primary shim) positioned inside a vibratory bowl 302 of a solid counting device 300, in accordance with the disclosed embodiments. It should be noted that the shim 304 is another view of the shim 104 depicted in FIG. 1 and the shim 204 depicted in FIGS. 2A-2E. It should also be noted that the solid counting device 300 is another view of the solid counting device 100 depicted in FIG. 1. More specifically, FIG. 3 depicts an enlarged and cutaway view of the solid counting device 100 of FIG. 1. In this regard, the solid counting device 300 shows certain elements and components of the solid counting device 100 in more detail. As shown, the solid counting device 300 includes a vibratory bowl 302 and a shim 304. As described previously with regard to FIG. 1, the exit channel 308 extends around the vibratory bowl 302, along the edge 306, and terminates at the exit opening 310. The exit channel 308 may be in the shape of a ramp, a chute, or any combination of a ramp and chute. In an example embodiment, the exit channel 308 may be bounded by a raised channel edge 318 and the edge 306 of the vibratory bowl 302.

In the embodiment shown, the shim 304 is positioned inside the exit channel 308 and fastened to an inner surface of the edge 306 of the vibratory bowl 302. The shim 304 is positioned to separate discrete solids traveling inside the vibratory bowl 302 such that the discrete solids are each counted individually during the counting process, to ensure an accurate total count. The shim 304 separates the discrete solid objects to create distance between the discrete solids (e.g., a gap) by: (i) permitting one discrete solid to travel into or on the exit channel 308 while obstructing additional discrete solids from entering the exit channel 308 at the same time or preventing discrete solids from traveling side-by-side on the exit channel 308, and (ii) permitting one discrete solid to travel into the exit opening 310 while obstructing additional discrete solids from entering the exit opening 310 at the same time, if in an unlikely case that a solid happens to arrive at the exit opening at the same time as another solid.

The shim 304 is capable of performing the separation of the discrete objects due to the positioning and the physical characteristics of the shim 304. A first end 312 of the shim 304 is operable to partially obstruct an entrance to the exit channel 308, to permit one discrete solid to travel into the exit channel 308 or on the exit channel 308 at a time and prevent the simultaneous entrance into the exit channel 308 of other discrete solid objects. The first end 312 of the shim 304 is positioned proximate to an entrance to the exit channel 308. In some embodiments, the first end 312 is positioned at the entrance to the exit channel 308. However, in other embodiments, the first end 312 may be slightly offset from the entrance to the exit channel 308. The first end 312 is operable to partially obstruct the entrance to the exit channel 308 based on at least one physical characteristic of the shim 304, including but not limited to: a shape of the shim 304, a width of the first end 312, and one or more projections 316 extending laterally from the first end 312.

The shim 304 curves around in a semi-circular shape to partially obstruct the exit channel 308 using the first end 312, e.g., the elongated body of the shim has an arcuate shape. The width of the first end 312 partially obstructs the exit channel 308. In certain embodiments, the width of the first end 312 includes a width of a projection 316 positioned at the first end 312. The first end 312 also includes one or more projections 316 that partially obstruct the exit channel 308 by extending laterally from the shim 304 into the exit channel 308.

As shown, the shim 304 is positioned adjacent to the exit opening 310 of the vibratory bowl 302. The shim 304 includes a second end 314 that narrows to a first end 312 with a projection 316. Here, the second end 314 of the shim 304 is positioned to partially obstruct the exit opening 310, to ensure that one of the discrete solids is capable of traveling through the exit opening 310 but any additional discrete solids is prevented from traveling through the exit opening 310 at the same time as the first one. In other words, only one discrete solid object fits through the exit opening 310 at a time, and other discrete solid objects are prevented from exiting via the exit opening 310 simultaneously.

The shim 304 operates as a partial obstruction to the entrance to the exit channel 308 and to the exit opening 310, based on sizes of the partial obstruction and the object to be prevented from accessing the partially obstructed path. A size of a discrete solid object corresponds to a shim size, and an appropriately sized shim 304 is selected, installed, and used to separate discrete solid objects of a particular type, for counting purposes. Shim size indicates a width of the first end 312 (including the projection 316) and a width of the second end 314. Since the second end 314 is operable to partially obstruct the exit opening 310 such that only one discrete solid object can enter the exit opening 310 at a time, the size of the discrete solid object determines a required width for the second end 314 of the shim 304. Similarly, since the first end 312 is operable to partially obstruct the entrance to the exit channel 308 such that only one discrete solid object can enter the exit channel 308 at a time, the size of the discrete solid object determines a required width for the first end 312 of the shim 304. In other words, a shim 304 is associated with a shim size, a plurality of solids is associated with a solid size, and the solid size indicates the shim size required to dispense and count the plurality of solids. Thus, a size of a particular type of solid object corresponds to one or more appropriate sizes of shim 304 for installation and use for separation of solids during the counting process.

FIG. 3B is a diagram of a secondary shim 320 positioned inside a vibratory bowl 302 of a solid counting device 300, in accordance with the disclosed embodiments. The secondary shim 320 may be used alone or in combination with the primary shim 304 (e.g., the shim 104 depicted in FIG. 1 and the shim 204 depicted in FIGS. 2A-2E). As described previously with regard to FIG. 3A, the solid counting device 300 is another view of the solid counting device 100 depicted in FIG. 1, and FIGS. 3A-3B depict enlarged, cutaway views of the solid counting device 100 of FIG. 1. As shown in FIG. 3B, the solid counting device 300 includes a vibratory bowl 302 and a secondary shim 320, and an exit channel 308 extends around the vibratory bowl 302, along the edge 306, and terminates at an exit opening 310. The exit channel 308 may be in the shape of a ramp, a chute, or any combination of a ramp and chute. In an example embodiment, the exit channel 308 may be bounded by a raised channel edge 318 and the edge 306 of the vibratory bowl 302.

In the embodiment shown, the secondary shim 320 is positioned inside the exit channel 308 and fastened to an inner surface of the edge 306 of the vibratory bowl 302. In this way, the secondary shim 320 and the primary shim 304 are similarly located, wherein the location is the interior of the exit channel 308. However, the positioning of the secondary shim 320 differs from the positioning of the primary shim 304 in that the secondary shim 320 does not physically contact an entirety of the bowl height of the inner surface of the edge 306 of the vibratory bowl 302, the secondary shim 320 extends into the interior of the vibratory bowl 302 from the inner surface of the edge 306, and the secondary shim 320 is elevated to a designated secondary shim positioning height from the bottom of the vibratory bowl 302.

First, with regard to positioning, the secondary shim 320 does not physically contact an entirety of the bowl height of the inner surface of the edge 306 of the vibratory bowl 302. Although the lengths of the primary shim 304 and the secondary shim 320 may be the same (or substantially the same length, within a margin of error), the secondary shim width and secondary shim height differ from width and height dimensions of the primary shim 304. More specifically, the width of the primary shim 304 is less than the height of the primary shim 304, as shown in FIGS. 1 and 3. In contrast to the primary shim 304, the width of the secondary shim 320 is greater than the height of the secondary shim 320, and the secondary shim 320 does not make contact with the entire height of the inner surface of the edge 306 of the vibratory bowl 302 (as shown in FIG. 3B).

Second, with regard to positioning, the secondary shim 320 extends horizontally into the interior of the vibratory bowl 302 from the inner surface of the edge 306. Here, the horizontal extension into the interior of the vibratory bowl 302 includes extension across a width of the exit channel 308 from the inner surface of the edge 306, and the horizontal extension into the exit channel 308 is the width of the secondary shim 320. In contrast, extension of the primary shim 304 into the interior of the vibratory bowl 302 includes the width of the second end 314 at the exit opening 310 narrowing to the width of the first end 312 and the projection 316 at the entrance to the exit channel 308 (as shown in FIG. 3A).

Third, with regard to positioning, the secondary shim 320 is elevated to a secondary shim positioning height that is greater than the height of one applicable discrete solid, but less than the height of two applicable solids "stacked" together such that a second solid is disposed on top of a first solid. Instead, the secondary shim 320 is positioned at an inner surface height that is greater than a height of an applicable discrete solid. More specifically, the secondary shim 320 is elevated to a secondary shim height that is (i) greater/taller than a pill height of one pill (i.e., one of the plurality of discrete solids), and (ii) less/shorter than a double pill height of two pills stacked vertically. In this way, the secondary shim 320 prevents stacked pills from traveling through the exit channel 308 and into the exit opening 310. The secondary shim 320 is positioned to physically separate stacked pills, as the vibratory bowl 302 is in motion, by obstructing the path forward for a higher pill disposed on top of a lower pill (i.e., stacked), while permitting the lower pill to pass underneath the secondary shim 320. In this scenario, the higher pill is prevented from moving forward inside the exit channel 308, and therefore a stack of two pills is not permitted to simultaneously travel through the exit opening 310.

In certain embodiments, the secondary shim 320 may be positioned at a height that is approximately 1.5 times the height of a particular medication solid. However, it should be appreciated that other embodiments may position the secondary shim 320 at any height that is taller than the applicable solid and shorter than double the height of the applicable solid.

The shim 304 is positioned to separate discrete solids traveling inside the vibratory bowl 302 such that the discrete solids are each counted individually during the counting process, to ensure an accurate total count. The shim 304 separates the discrete solid objects to create distance between the discrete solids (e.g., a gap) by: (i) permitting one discrete solid to travel into or on the exit channel 308 while obstructing additional discrete solids from entering the exit channel 308 at the same time or preventing discrete solids from traveling side-by-side on the exit channel 308, and (ii) permitting one discrete solid to travel into the exit opening 310 while obstructing additional discrete solids from entering the exit opening 310 at the same time, if in an unlikely case that a solid happens to arrive at the exit opening at the same time as another solid.

FIGS. 4-10 present processes for performing solid counting functions using a solid counting device or system (processes 400-700) and preparing the solid counting device or system for use (processes 800-1000). The various tasks performed in connection with processes 400-1000 may be performed by device or system components, software, hardware, firmware, or any combination thereof. For illustrative purposes, the following descriptions of processes 400-1000 may refer to elements mentioned above in connection with FIGS. 1-3. In practice, portions of processes 400-1000 may be performed by different elements of the described system. It should be appreciated that processes 400-1000 may include any number of additional or alternative tasks, the tasks shown in FIGS. 4-10 need not be performed in the illustrated order, and processes 400-1000 may be incorporated into additional, more comprehensive procedures or processes having additional functionality not described in detail herein. Moreover, one or more of the tasks shown in FIGS. 4-10 could be omitted from embodiments of the processes 400-1000 as long as the intended overall functionality remains intact.

Figure 4:
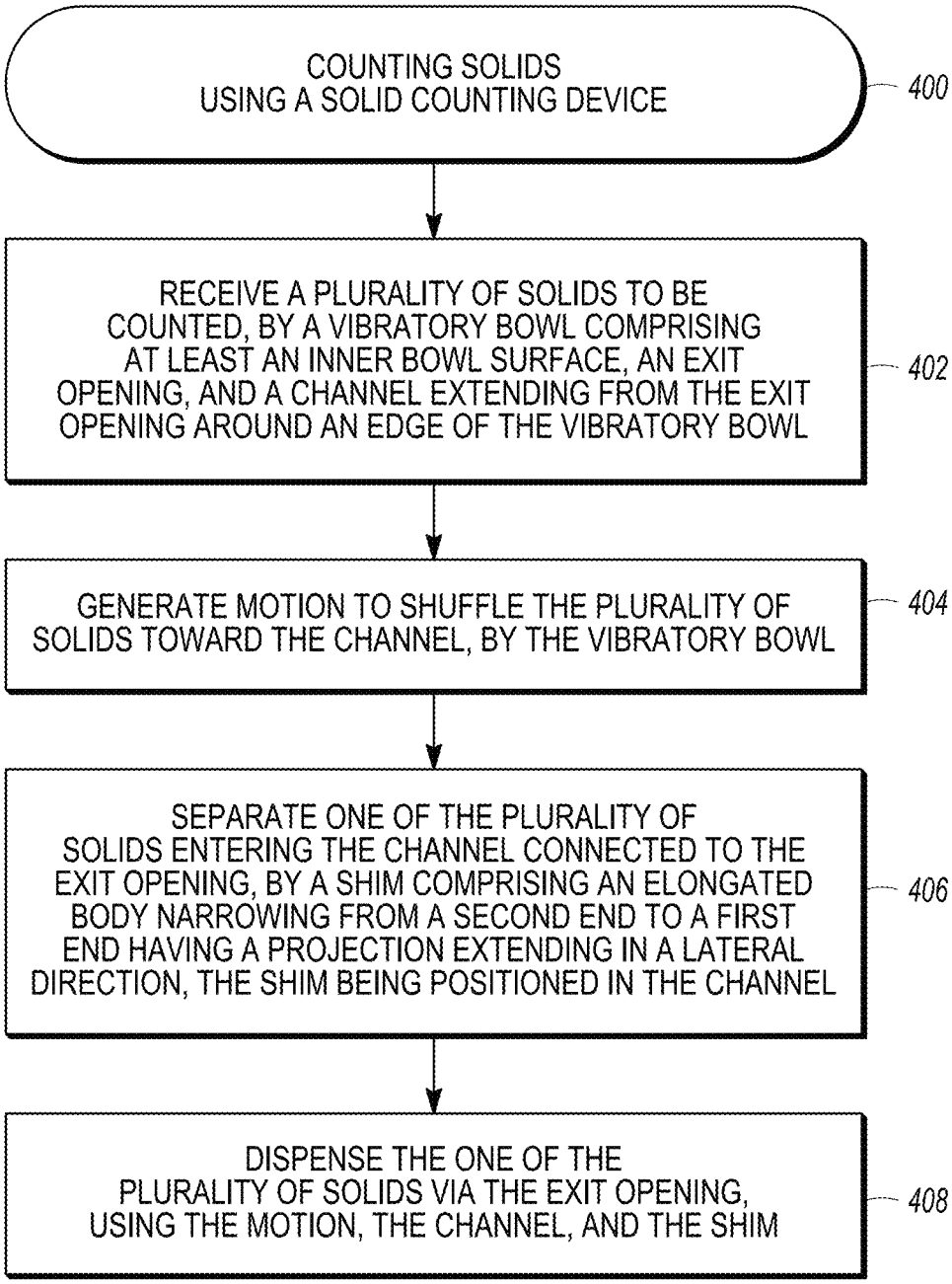
FIG. 4 is a flow chart that illustrates an embodiment of a process for counting solids using a solid counting device.

FIG. 4 is a flow chart that illustrates an embodiment of a process 400 for counting solids using a solid counting device. The process 400 receives a plurality of solids to be counted, by a vibratory bowl comprising at least an inner bowl surface, an exit opening, and a channel extending from the exit opening around an edge of the vibratory bowl (step 402). Exemplary embodiments of the process 400 are implemented in a pharmacy fulfillment environment, and the plurality of solids (i.e., discrete solid objects) are medications. Discrete, countable pieces of medication may include pills, tablets, capsules, chewable solids, "gummy" medication, and/or any type of medication encased in a firm coating to create a solid form (e.g., gel-caps, gel-tabs, liquid capsules). For purposes of the present disclosure, the discrete, countable pieces of medication may be referred to as solids, medication solids, discrete objects, discrete solid objects, discrete pieces, or the like.

Some embodiments of the process 400 may receive the plurality of solids via manual insertion into the vibratory bowl, or manual insertion into a ramp, chute, trough, tube, pipe, or other device or mechanism for a plurality of solids to travel into the vibratory bowl. As described herein, the manual insertion may be one aspect of a semi-automated procedure for counting the discrete solids. In other embodiments, the process 400 may receive the plurality of solids via any appropriate automated mechanism, including but not limited to automatic dispensing machines for transfer into the vibratory bowl, an autonomous robotic arm for retrieval and transfer into the vibratory bowl, or the like. Such automated processes typically include steps performed using machinery and/or computing equipment without (or with minimal) human participation.

The process 400 also generates motion to shuffle the plurality of solids toward the channel, by the vibratory bowl (step 404). Here, the vibratory bowl operates as part of a motion generation system and produces a vibration motion to move the discrete solid objects inside the bowl. During the motion generation, one or more solids move in a direction leading into the exit channel of the vibratory bowl. Any applicable type of motion generation system may be used.

The process 400 separates one of the plurality of solids entering the channel connected to the exit opening, by a shim comprising an elongated body narrowing from a second end to a first end having a projection extending in a lateral direction, the shim being positioned in the channel (step 406). One methodology for separating one of the plurality of solids entering the channel is described below with reference to FIG. 6.

Here, the shim operates in conjunction with the generated motion of the vibratory bowl (step 404) to separate one solid from a plurality of solids in the bowl. The separation is performed as the one solid enters an exit channel of the vibratory bowl and/or as the one solid travels into the exit opening of the vibratory bowl. In this way, the process 400 prevents any group of closely-positioned solids being counted as one solid, thereby ensuring an accurate count of individual, discrete solids.

The process 400 then dispenses the one of the plurality of solids via the exit opening, using the motion, the channel, and the shim (step 408). Thus, the one solitary, discrete solid exits the vibratory bowl, for counting purposes, after being separated from any other solids inside the vibratory bowl.

Figure 5:
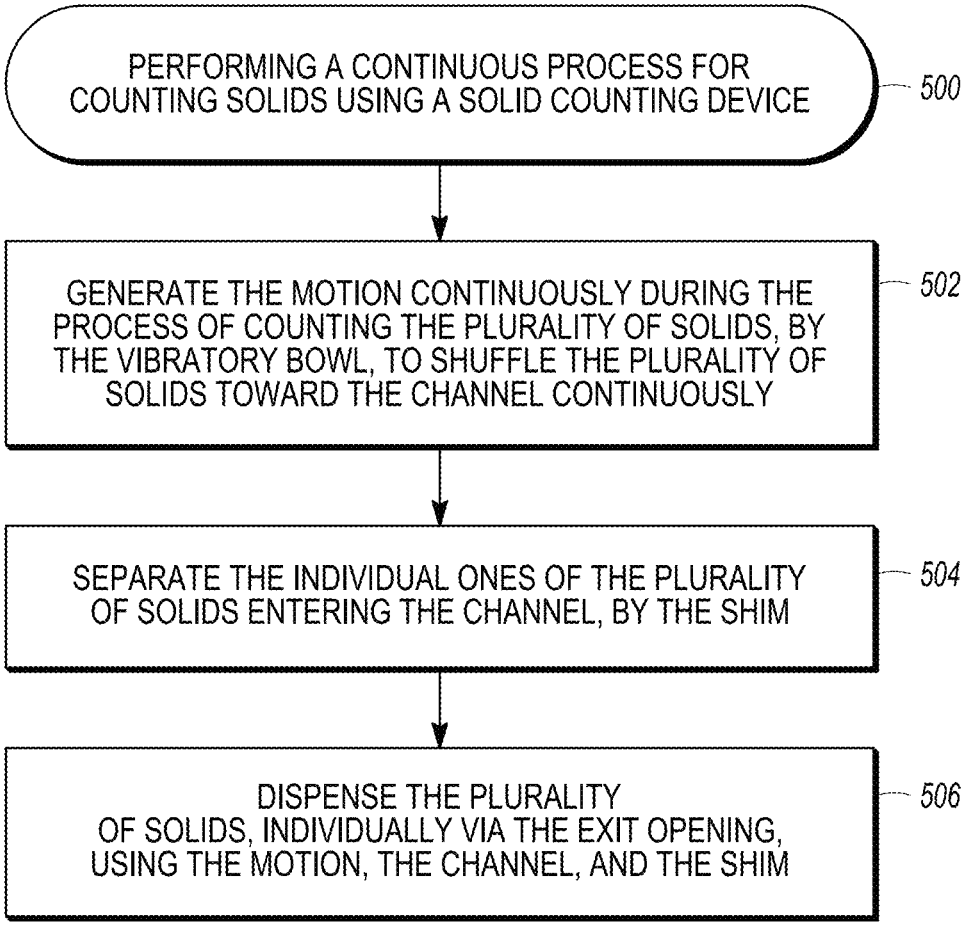
FIG. 5 is a flow chart that illustrates an embodiment of a process for performing a continuous process for counting solids using a solid counting device.

FIG. 5 is a flow chart that illustrates an embodiment of a process 500 for performing a continuous procedure (i.e., process, set of action steps) for counting solids using a solid counting device. It should be appreciated that process 500 represents one particular embodiment of process 400 described above with regard to process 400 of FIG. 4. More specifically, the process 500 performs a continuous procedure, or in other words, continuously performs steps 502-506 for the purpose of counting a plurality of solids inside a vibratory bowl.

The process 500 generates the motion continuously during the counting of the plurality of solids, by the vibratory bowl, to shuffle the plurality of solids toward the exit channel continuously (step 502). As described herein with regard to step 404 of FIG. 4, the vibratory bowl operates as part of a motion generation system to generate a vibration motion (or other applicable type of motion) to move the solids inside the vibratory bowl. Here, the motion causes the solids to travel in various directions, including in the direction of the exit channel and the exit opening.

As one or more solids travel toward and inside the exit channel, the process 500 separates individual ones of the plurality of solids entering the channel, by the shim (step 504). As descried herein with regard to step 406 of FIG. 4, the process 500 separates each of the plurality of solids entering the channel, and each discrete solid object enters the channel alone.

The process 500 dispenses the plurality of solids, individually via the exit opening, using the motion, the channel, and the shim (step 506), such that the counting system is capable of counting each solitary, discrete solid object and generating an accurate count. Upon exiting the vibratory bowl, each individual solid that has been separated from other solids is counted. Thus, process 500 performs the continuous procedure to count the plurality of solids in its entirety.

Figure 6:
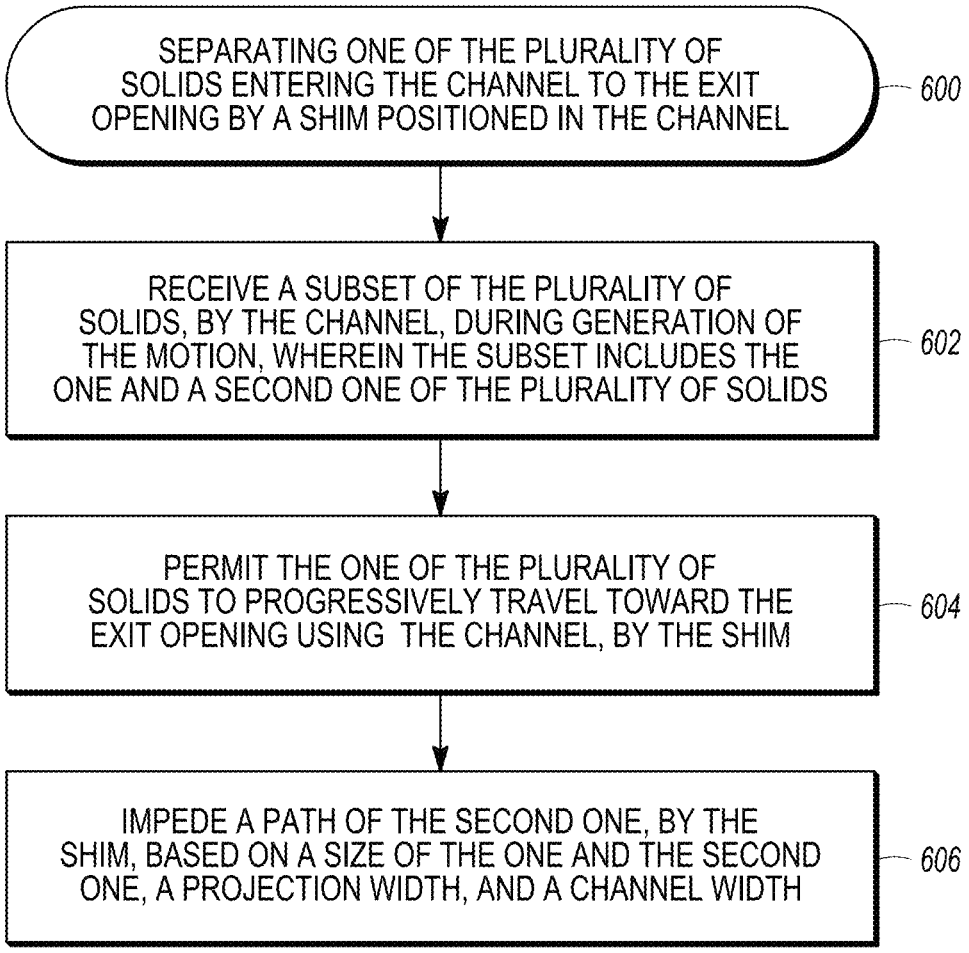
FIG. 6 is a flow chart that illustrates an embodiment of a process for separating one of the plurality of solids entering the channel connected to the exit opening, by a shim positioned in the channel.

FIG. 6 is a flow chart that illustrates an embodiment of a process 600 for separating one of the plurality of solids entering the channel connected to the exit opening, by a shim positioned in the channel. It should be appreciated that the process 600 described in FIG. 6 represents one embodiment of step 406 described above in the discussion of FIG. 4, including additional detail.

The process 600 receives a subset of the plurality of solids, by the channel, during generation of the motion, wherein the subset includes the one and a second one of the plurality of solids (step 602). As described previously with reference to FIG. 4, movement of a plurality of solids inside the vibratory bowl is produced by a motion generation system that includes the vibratory bowl. The plurality of solids do not actively move by independently producing their own motion, but instead the solids are passively shuffled around inside the vibratory bowl as the generated motion of the vibratory bowl acts upon the plurality of solids. Due to the shuffling of the solids around the bowl, the solids are moved into different locations of the bowl including the exit channel that extends from the exit opening along an edge of the vibratory bowl.

In the particular embodiment described here, during the motion generation and resulting vibrations of the bowl, at least two discrete solid objects travel to an entrance of the exit channel. As described previously, a shim is positioned inside the vibratory bowl such that the entrance to the exit channel is partially obstructed by the shim and only one discrete solid object can pass through the entrance and into the channel. Here, the process 600 permits the one of the plurality of solids to progressively travel toward the exit opening using the channel, by the shim (step 604), and the process 600 impedes a path of the second one, by the shim, based on a size of the one and the second one, a projection width, and a channel width (step 606). One methodology for impeding the path of the second one is described below with reference to FIG. 7. The process 600 uses the shim to partially obstruct the entrance to the exit channel, creating an entrance appropriately sized for one discrete solid, and therefore preventing two discrete solids from entering the exit channel at the same time. By allowing the first solid to continue to travel in a particular direction into the channel while preventing the second solid from continuing to travel into the channel, the process 600 creates separation between the two solids.

Figure 7:
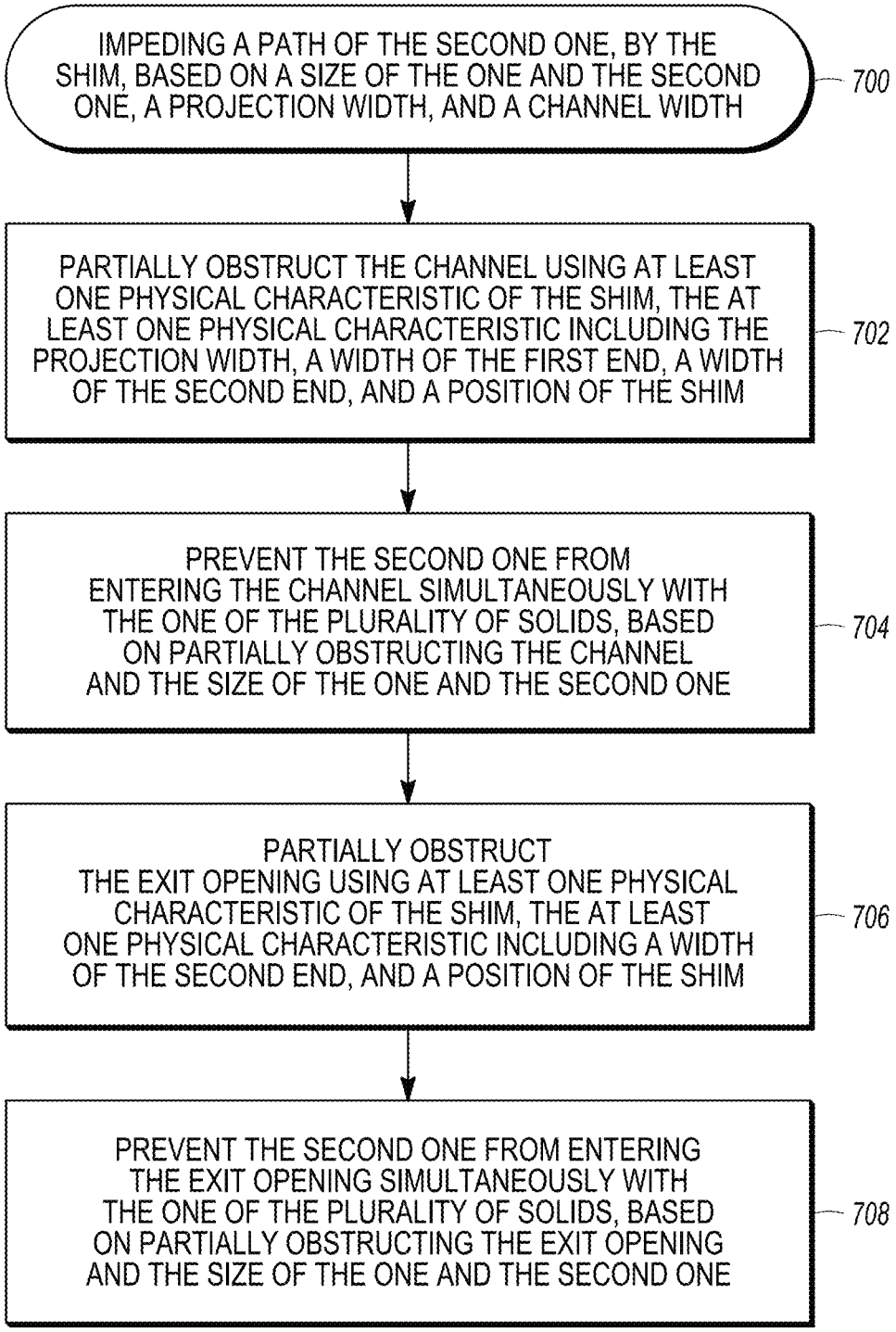
FIG. 7 is a flow chart that illustrates an embodiment of a process for impeding a path of a second one of the plurality of solids, by the shim.

FIG. 7 is a flow chart that illustrates an embodiment of a process 700 for impeding a path of a second one of the plurality of solids, by the shim. It should be appreciated that the process 700 described in FIG. 7 represents one embodiment of step 606 described above in the discussion of FIG. 6, including additional detail.

The process 700 partially obstructs the channel using at least one physical characteristic of the shim, the at least one physical characteristic including the projection width and a width of the first end (step 702). As described previously with regard to FIGS. 1-3, the shim positioned inside the vibratory bowl includes a wider second end positioned at an exit opening of the bowl, and the second end narrows to the first end that includes a projection extending laterally into the exit channel. Here, the process 700 uses the projection width and the width of the first end to partially obstruct the entrance to the channel.

The process 700 may use a shim having a first end width and a projection width appropriate to the type of solid being moved around inside the vibratory bowl and separated for counting purposes. The first end width and/or the projection width may be larger when used with smaller solids. Similarly, the first end with and/or the projection width may be smaller when used with larger solids. In some embodiments, the process 700 may also use a shape of the shim to partially obstruct an entrance to the channel. For example, the shim may be curved to a particular degree for a first partial obstruction appropriate to a first type of discrete solid object. In this scenario, a second type of discrete solid object may be smaller than the first type, and the shim used for the second type may include a physical characteristic of an increased curve to produce an increased obstruction to the channel.

The process 700 prevents the second one from entering the channel simultaneously with the one of the plurality of solids, based on partially obstructing the channel and the size of the one and the second one (step 704). Here, the process 700 uses at least the projection width and the width of the first end to partially obstruct an entrance to the channel such that one discrete solid object can travel into the channel due to size constraints. The part of the channel width that is unobstructed at the entrance to the channel permits one solid at a time to pass into the channel toward the exit opening, thereby separating a first solid and a second solid that may be "bunched" together, or otherwise moving around the bowl positioned closely together with a group or subset of the solids. The first opportunity for the process 700 to use the shim to separate one of the solids for counting purposes as the solid nears the exit opening of the bowl is when the solid enters the channel leading to the exit opening.

The process 700 also partially obstructs the exit opening using at least one physical characteristic of the shim, the at least one physical characteristic including a width of the second end and a position of the shim (step 706). Here, the process 700 uses the width of the second end and the positioning of the wider second end of the shim at the exit opening to partially obstruct the exit opening of the vibratory bowl. In this way, only one discrete solid object is permitted travel into the exit opening at one time, due to size constraints. The portion of the exit opening that is unobstructed permits one solid at a time to pass into the exit opening, thereby separating a first solid and a second solid that may be moving around the inside of the vibratory bowl while positioned closely together. The second opportunity for the process 700 to use the shim to separate one of the solids for counting purposes is when the solid has traveled through the channel and has reached the exit opening.

The process 700 prevents the second one from entering the exit opening simultaneously with the one of the plurality of solids, based on partially obstructing the exit opening and the size of the one and the second one (step 708). Here, the process 700 uses a second width of the second end of the shim to partially obstruct the exit opening of the vibratory bowl such that one discrete solid object can travel through the exit opening to be counted, due to size constraints. The part of the exit opening that is unobstructed permits one solid at a time to pass into, and through, the exit opening, thereby separating a first solid from any other solid that may have traveled into the exit channel before or after the first solid. The second opportunity for the process 700 to use the shim to separate one of the solids for counting purposes is when the solid travels through the exit opening leading to the counting mechanism.

Figure 8:
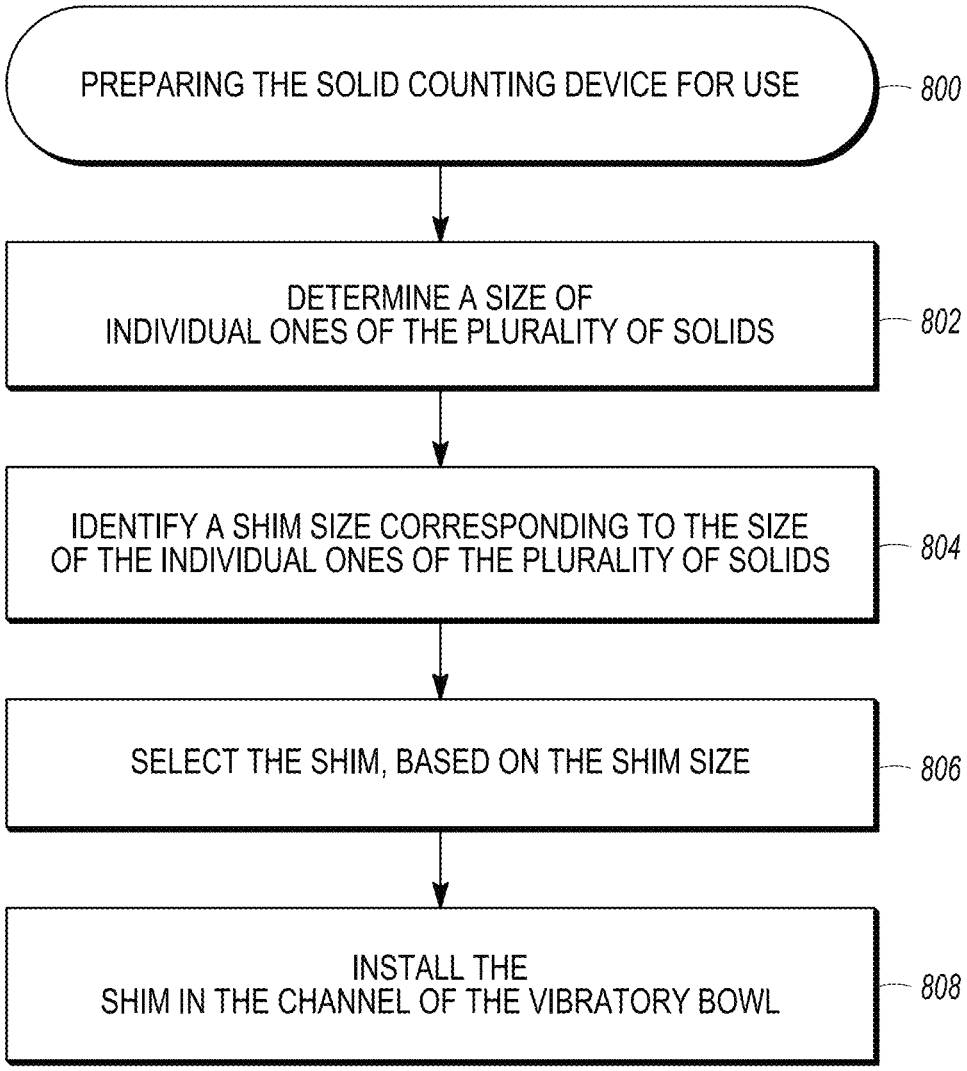
FIG. 8 is a flow chart that illustrates an embodiment of a process for preparing a solid counting device for use.

FIG. 8 is a flow chart that illustrates an embodiment of a process 800 for preparing a solid counting device for use. Typical embodiments of a solid counting device may be used for various types and sizes of discrete solid objects, and features of the solid counting device may be customized to accommodate such variations in type, size, or other characteristics of a plurality of solids to be counted.

The process 800 determines a size of individual ones of the plurality of solids (step 802). The size of each solid object can vary greatly. Exemplary embodiments of the process 800 may be used in a pharmacy fulfillment environment, where each of the plurality of solids may be very small or very large. Here, the process 800 identifies the size of each of the plurality of solids to be counted. Typically, the plurality of solids inserted into the vibratory bowl for counting is uniform in size. In other words, each of the plurality of solids is the same size. The size of the plurality of solids varies between batches of solids, and each batch of solids includes one type of solid having one size applicable to the entire batch.

The process 800 identifies a shim size corresponding to the size of the individual ones of the plurality of solids (step 804). To perform an accurate counting procedure for discrete solid objects, a solid counting device depends on its capability of separating each of the solid objects. Shim sizes vary based on the application. Certain shim sizes are better suited to separate solids of particular sizes, and certain shim sizes may not function to separate solids of some sizes. Here, the process 800 identifies a shim size appropriate to perform the separation and counting procedure for the particular solids being counted, based on the size of the solids.

The process 800 selects the shim, based on the shim size (step 806), and the process 800 installs the shim in the channel of the vibratory bowl (step 808). One methodology for installing the shim is described below with reference to FIG. 9, including additional detail. In some embodiments, the shim selection and installation may be part of a semi-automated procedure, where the shim is selected and installed manually for use as part of the automated separation and counting procedure. In some embodiments, the shim selection and installation may be part of an automated procedure, wherein a computerized and/or mechanized system is employed to select and change shims according to shim size and the size of the particular solids being counted using the solid counting device.

Figure 9:
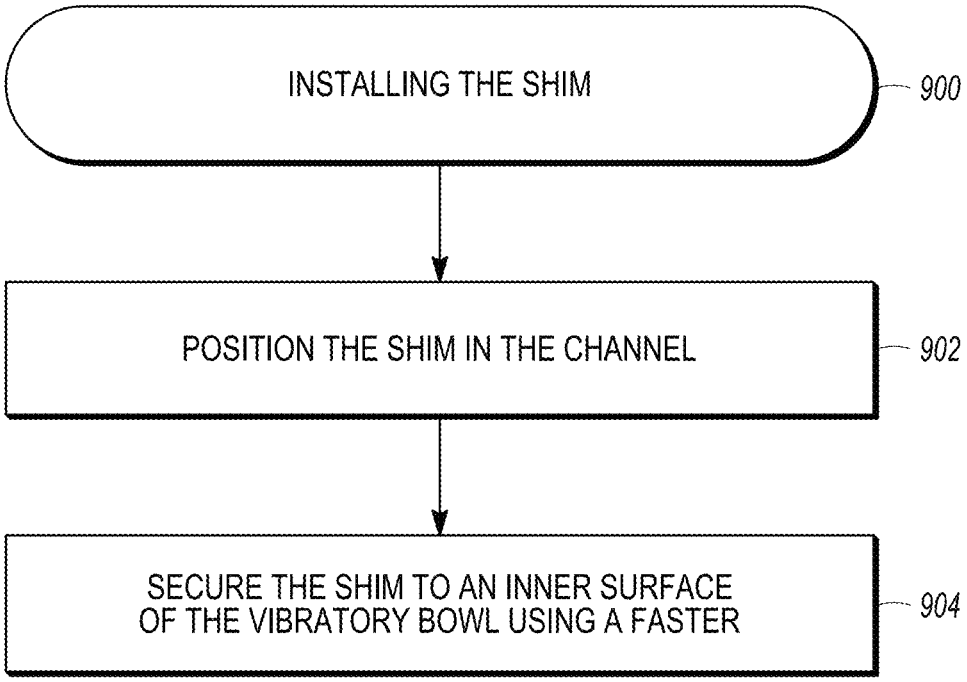
FIG. 9 is a flow chart that illustrates an embodiment of a process for installing a shim in a solid counting device.

FIG. 9 is a flow chart that illustrates an embodiment of a process 900 for installing a shim in a solid counting device. It should be appreciated that the process 900 described in FIG. 9 represents one embodiment of step 808 described above in the discussion of FIG. 8, including additional detail. As described previously with regard to FIG. 8, certain embodiments of shim installation may be part of a semi-automated procedure, where the shim is installed manually for use as part of an automated separation and counting procedure. Some embodiments of shim installation may be part of an automated procedure, using a computerized and/or mechanized system to install shims without requiring manual intervention.

Prior to generating the motion of the vibratory bowl, the process 900 positions the shim in the channel (step 902) and secures the shim to an inner surface of the vibratory bowl using a fastener (step 904). One methodology for positioning the shim in the channel is described below with reference to FIG. 10, including additional detail.

The positioning of the shim in the exit channel of the vibratory bowl enables the shim to separate an individual one of the plurality of solids from the remainder of the plurality, for counting purposes. The separation ensures that a "clump" or "bunch" or otherwise co-located group of solids is not misinterpreted by the solid counting device as being one solid and therefore being counted as one solid. Here, the process 900 positions the shim inside the channel, as required for the particular application. Once positioned, the process 900 secures the shim to the inside of the vibratory bowl using a fastener, such as a bolt, a clamp, or the like. Securing the shim ensures uniformity of performance of the separation procedure.

Figure 10:
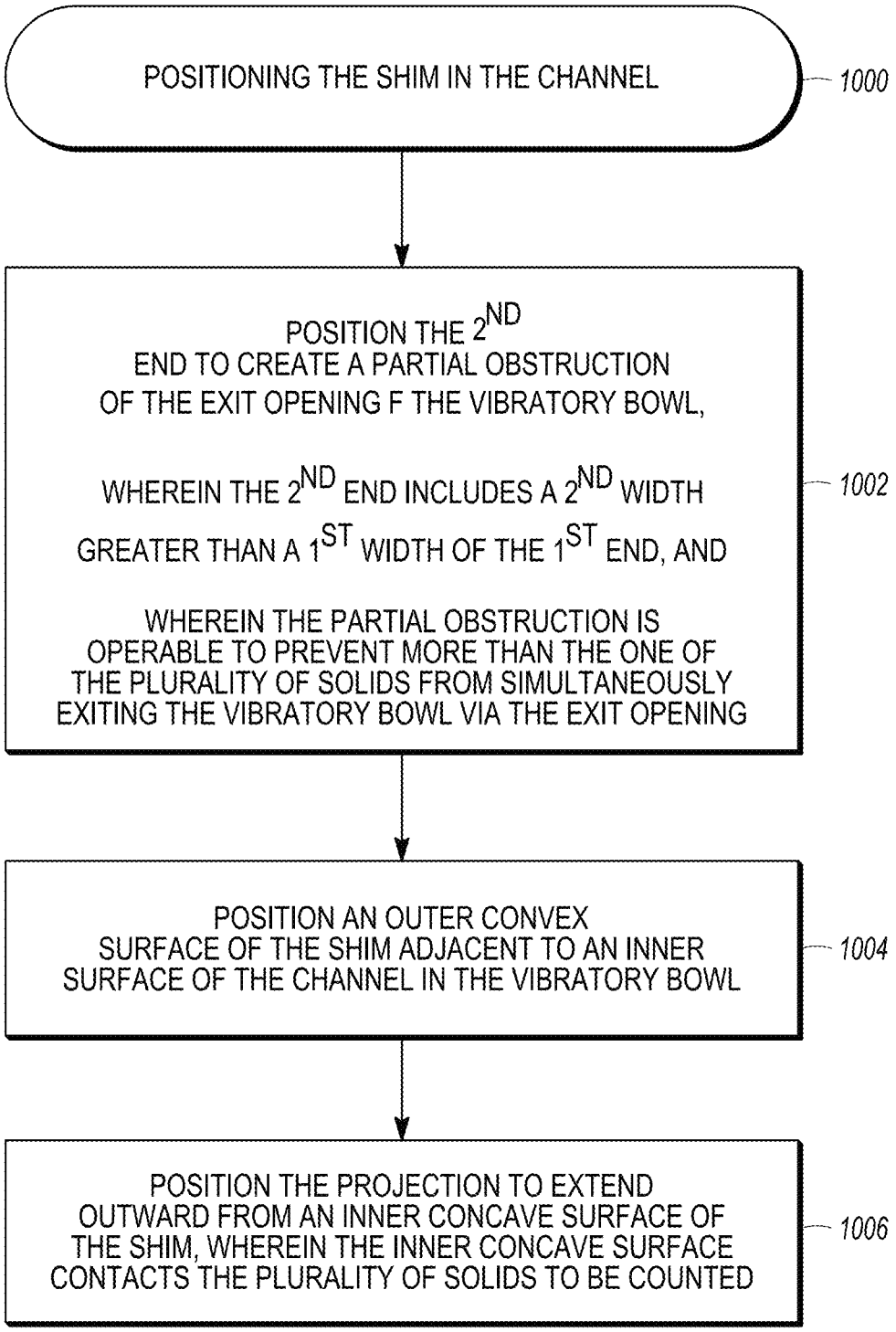
FIG. 10 is a flow chart that illustrates an embodiment of a process for positioning a shim in an exit channel of a solid counting device.

FIG. 10 is a flow chart that illustrates an embodiment of a process 1000 for positioning a shim in an exit channel of a solid counting device. It should be appreciated that the process 1000 described in FIG. 10 represents one embodiment of step 902 described above in the discussion of FIG. 9, including additional detail. As described previously with regard to FIGS. 8 and 9, embodiments of shim installation may be part of a semi-automated procedure (e.g., a shim is installed manually for use as part of an automated separation and counting procedure) or an automated procedure (e.g., using a computerized and/or mechanized system to perform machine installation of a shim).

The process 1000 positions the second end to create a partial obstruction of the exit opening of the vibratory bowl (step 1002). As described herein, the second end of the shim includes a second width greater than a first width of the first end. In other words, a wide second end of the shim tapers to a first end that is narrower than the second end. Here, the process 1000 positions the second end at the exit opening, and uses the width of the second end to create a partial obstruction to the exit opening. The partial obstruction is operable to prevent more than the one of the plurality of solids from simultaneously exiting the vibratory bowl via the exit opening. In this way, a group of solids attempting to travel through the exit opening simultaneously would be prevented from doing so, based on the positioning of the second end of the shim.

The process 1000 positions an outer convex surface of the shim adjacent to an inner surface of the channel in the vibratory bowl (step 1004). The shape of the shim is curved, creating an outer convex surface and an inner concave surface. The outer convex surface of the shim is typically positioned to align with the inner surface of the vibratory bowl, inside the exit channel extending from the exit opening around an edge of the vibratory bowl.

The process 1000 positions the projection to extend outward from an inner concave surface of the shim, wherein the inner concave surface contacts the plurality of solids to be counted (step 1006). The process 1000 positions the shim such that the inner concave surface of the shim is turned toward the center of the vibratory bowl, wherein the plurality of discrete solid objects contact the inner concave surface when motion is generated and the discrete solid objects are shuffled inside the vibratory bowl. The process 1000 also positions the shim to extend the projection outward from the inner concave surface toward the center of the inside of the vibratory bowl. Here, the process 1000 positions the projection at a beginning or entrance to the exit channel, and uses the width of the projection to create a partial obstruction to the exit channel. The partial obstruction is operable to prevent more than the one of the plurality of solids from simultaneously entering the exit channel. In this way, a group of solids attempting to travel into the exit channel simultaneously would be prevented from doing so, based on the positioning of the projection of the shim.

Figure 11:
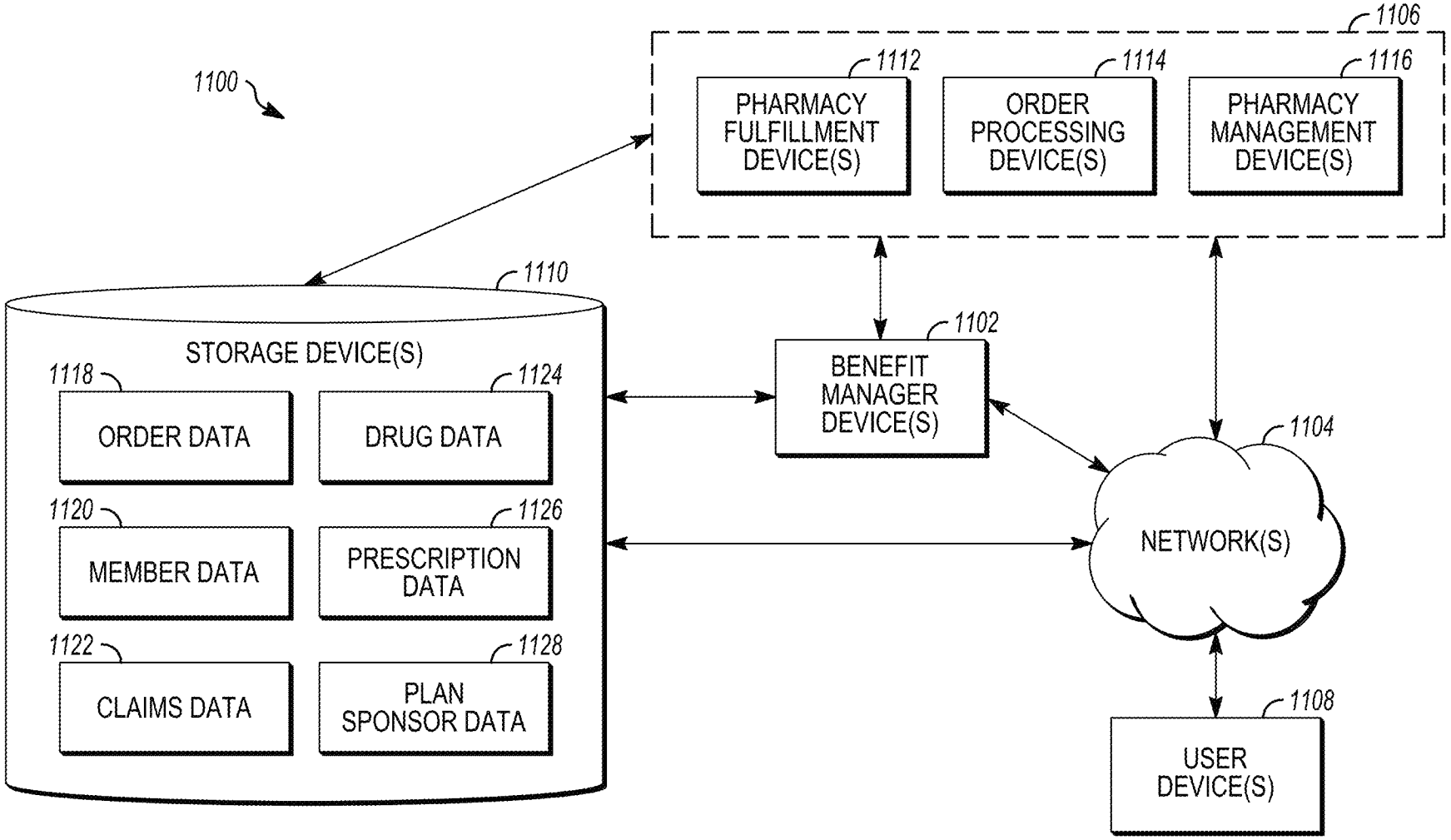
FIG. 11 is a block diagram of a medication filling assembly system that includes a solid counting device, in accordance with the disclosed embodiments.

FIG. 11 is a block diagram of an example implementation of a medication filling assembly system 1100 that includes a solid counting device, in accordance with the disclosed embodiments. While the system 1100 is generally described as being deployed in a high volume pharmacy or fulfillment center (e.g., a mail order pharmacy, a direct delivery pharmacy, an automated pharmacy, multiple package delivering center, and the like), the system 1100 and/or components thereof may otherwise be deployed (e.g., in a lower volume pharmacy or another dispenser of large numbers of small items). A high volume pharmacy may be a pharmacy that is capable of filling prescriptions automatically, mechanically, manually, or a combination thereof. The system 1100 may include a benefit manager device 1102, a pharmacy device 1106, and a user device 1108, which may communicate with each other directly and/or over a network 1104. The system may also include a storage device 1110.

The benefit manager 1102 is a device operated by an entity that is at least partially responsible for creation and/or management of the pharmacy or drug benefit. While such an entity operating the benefit manager device 1102 is typically a pharmacy benefit manager (PBM), other entities may operate the benefit manager device 1102 either on behalf of themselves, the PBM, another entity, or other entities. For example, the benefit manager device 1102 may be operated by a health plan, a retail pharmacy chain, a drug wholesaler, a data analytics or other type of software-related company, or the like. In some embodiments, a PBM that provides the pharmacy benefit may also provide one or more than one additional benefits including a medical or health benefit, a dental benefit, a vision benefit, a wellness benefit, a radiology benefit, a pet care benefit, an insurance benefit, a long term care benefit, a nursing home benefit, and the like. The PBM may, in addition to its PBM operations, operate one or more than one pharmacy.

Some of the operations of the PBM that operates the benefit manager device 1102 may include the following activities and processes. A member (or a person on behalf of the member) of a pharmacy benefit plan administered by or through the PBM attempts to obtain a prescription drug at a retail pharmacy location (e.g., a location of a physical store) from a pharmacist or a pharmacist technician. The member may also attempt to obtain the prescription drug through mail order drug delivery, from a mail order pharmacy location, which may be the medication filling assembly system 1100. In some embodiments, the member may also attempt to obtain the prescription drug directly or indirectly through the use of a machine, such as a kiosk, vending unit, mobile electronic device, or a different type of mechanical electrical, electronic communication device, and/or computing device. Such a machine may be filled with the prescription drug in prescription packaging, which may include multiple prescription components, prepared by the medication filling assembly system 1100.

The member may have a copayment for the prescription drug that reflects an amount of money that the member is responsible to pay the pharmacy for the prescription drug. The money paid by the member to the pharmacy may come from personal funds of the member, a health savings account (HSA) of the member or the member's family, a health reimbursement arrangement (HRA) of the member or the member's family, a flexible spending account (FSA) of the member or the member's family, or the like. In some instances, an employer of the member may directly or indirectly fund or reimburse the member for the copayments.

The amount of the co-pay required form the member may vary with different pharmacy benefit plans having different plan sponsors or clients and/or prescription drugs. The member's copayment may be based on a flat copayment (e.g., $10), co-insurance (e.g., 10%), and/or a deductible (e.g., for first $500 of annual prescription drug expenses) for certain prescription drugs, certain types and/or classes of prescription drugs, and/or all prescription drugs. The copayment may be stored in the storage 1110 or determined by the benefit manager device 1102.

In some instances, the member may not pay the copayment or may only pay a portion of the copayment for the prescription drug. For example, if the usual and customary cost for a generic version of a prescription drug is $4, and the member's flat copayment is $20 for the prescription drug, the member may only be required to pay $4 to receive the prescription drug. In another example involving a worker's compensation claim, no copayment may be due by the member for the prescription drug.

In addition, copayments may also vary based on different delivery channels used for the prescription drug to be received by the member. For example, the copayment for receiving the prescription drug from a mail order pharmacy location may be less than the copayment for receiving the prescription drug from a retail pharmacy location.

In conjunction with receiving the copayment (if any) from the member and dispensing the prescription drug to the member, the pharmacy submits a claim to the PBM for the prescription drug. After receiving the PBM (e.g., through the benefit manager device 1102) may perform certain adjudication operations including verifying eligibility for the member, identifying and/or reviewing an applicable formulary for the member to determine any appropriate copayment, coinsurance, and deductible for the prescription drug, and performing a drug utilization review (DUR) on the member. The PBM provides a response to the pharmacy (e.g., from the benefit manager device 1102 to the pharmacy device 1106) following performance of at least some of the operations mentioned herein.

As part of the adjudication, a plan sponsor (or the PBM on behalf of the plan sponsor) ultimately reimburses the pharmacy for filling the prescription drug when the prescription drug was successfully adjudicated.

The aforementioned adjudication operations generally occur before the copayment is received and the prescription drug is dispensed. However, in some instances these operations may occur simultaneously, substantially simultaneously, or in a different order. In addition, more or less adjudication operations may be performed as at least part of the adjudication process.

The amount of reimbursement paid to the pharmacy by a plan sponsor and/or money paid by the member may be determined at least partially based on the type(s) of pharmacy network in which the pharmacy is included. Other factors may also be used to determine the amount in addition to the type of pharmacy network. For example, if the member pays the pharmacy for the prescription drug without the prescription drug benefit provided by the PBM (e.g., by paying cash without use of the prescription drug benefit or by use of a so-called pharmacy discount card offering other negotiated rates), the amount of money paid by the member may be different than when the member uses prescription or drug benefit. In some embodiments, the amount of money received by the pharmacy for dispensing the prescription drug and for the prescription drug itself may be higher than when the member uses the prescription or drug benefit. Some or all of the foregoing operations may be performed by executing instructions stored on the benefit manager device 102 and/or an additional device.

Examples of the network 1104 include Mobile Communications (GSM) network, a code division multiple access (CDMA) network, 3rd Generation Partnership Project (3GPP) network, an Internet Protocol (IP) network, a Wireless Application Protocol (WAP) network, a Wi-Fi network, or an IEEE 802.11 standards network, as well as various combinations thereof. The network 1104 may include an optical communication network. The network 1104 may be a local area network or a global communication network, such as the Internet. In some embodiments, the network 1104 may include a network dedicated to prescription orders, e.g., a prescribing network such as the electronic prescribing network operated by Surescripts of Arlington, Virginia.

Moreover, although the system shows a single network 1104, multiple networks can be used. The multiple networks may communicate in series with each other to link the devices 1102, 1106-1110 or in parallel to link the devices 1102, 1106-1110.

The pharmacy device 1106 may include an order processing device 1114, a pharmacy manager device 1116, and a pharmacy fulfillment device 1112 in communication with each other directly and/or over the network 1104.

The order processing device 1114 may receive information regarding filling prescriptions and may direct an order component to one or more than one of the devices of the pharmacy fulfillment device 1112 at a pharmacy. The pharmacy fulfillment device 1112 may fulfill, dispense, aggregate, and/or pack the order components of the prescription drugs in accordance with one or more than one of the prescription orders directed by the order processing device 1114. The order processing device 1114 may be deployed in the system 1100 or may otherwise be used. The pharmacy fulfillment device 1112 may include a solid counter device that includes at least one shim, as described herein. The shim may be implemented as an elongated body extending from a wider second end to a narrower first end that includes a projection. The projection may be used to push apart, split up, or otherwise physically separate two discrete solid objects (e.g., medication pills, tablets, or the like). Such physical separation enables the pharmacy fulfillment device 1112 to count or tally the number of discrete solids inside the solid counter device with increased accuracy.

In general, the order processing device 1114 is a device located within or otherwise associated with the pharmacy to enable fulfillment of a prescription and dispensing prescription drugs by the pharmacy fulfilment device 1112. In some embodiments, the order processing device 1114 may be an external device separate from the pharmacy and communicate with other devices located within the pharmacy.

For example, the external order processing device 1114 may communicate with an internal order processing device 1114 and/or other devices located within the system 1100. In some embodiments, the external order processing device 1114 may have limited functionality (e.g., as operated by a patient requesting fulfillment of a prescription drug), while the internal pharmacy order processing device 1114 may have greater functionality (e.g., as operated by a pharmacist).

The order processing device 1114 may track the prescription order as it is fulfilled by the pharmacy fulfillment device 1112. The prescription order may include one or more than one prescription drugs to be filled by the pharmacy. The order processing device 1114 may make pharmacy routing decisions and/or order consolidation decisions for the particular prescription order. The pharmacy routing decisions may include what device(s) in the pharmacy are responsible for filling or otherwise handling certain portions of the prescription order. The order consolidation decisions include whether portions of one prescription order or multiple prescription orders should be shipped together for a patient or a patient family. The order processing device 1114 may also track and/or schedule literature or paperwork associated with each prescription order or multiple prescription orders that are being shipped together.

The pharmacy management device 1116 may enable and/or facilitate management and operations in a pharmacy. For example, the pharmacy management device 1116 may provide functionality to enable receipt and processing of prescription drug claims, management of pharmacy personnel, management of pharmaceutical and non-pharmaceutical products, track products in the pharmacy, record workplace incidents involve personnel and products, and the like. In some embodiments, the order processing device 1114 may operate in combination with the pharmacy management device 1116.

In some embodiments, the pharmacy management device 1116 may be a device associated with a retail pharmacy location (e.g., exclusive pharmacy location, a grocery store with a retail pharmacy, or a general sales store with a retail pharmacy) or other type of pharmacy location at which a member attempts to obtain a prescription. The pharmacy management device 1116 may be utilized by the pharmacy to submit the claim to the PBM (e.g., through the benefit management device 1102) for adjudication.

In some embodiments, the pharmacy management device 1116 may enable information exchange between the pharmacy and the PBM, for example, to allow the sharing of member information such as drug history, and the like, that may allow the pharmacy to better service a member (e.g., by providing more informed therapy consultation and drug interaction information, etc.). In some embodiments, the benefit manager 1102 may track prescription drug fulfillment and/or other information for patients that are not members or have not identified themselves as members, at the time (or in conjunction with the time) in which they seek to have a prescription filled at a pharmacy.

The pharmacy fulfillment devices 1112, the order processing device 1114, and/or the pharmacy management device 1116 may include circuitry, a processor, a memory to store data and instructions, and communication functionality. These devices 1112-1116, in some embodiments are dedicated to performing processes, methods and/or instructions described herein. Other types of electronic devices specifically configured to implement with the processes, methods and/or instructions described herein may also be used.

In some embodiments, at least some functionality of the order processing device 1114 may be included in the pharmacy management device 1116 may include circuitry, a processor, a memory to store data and instructions, and communication functionality. These devices 1112-1116, in some embodiments, are dedicated to performing processes, methods and/or instructions described herein. Other types of electronic devices specifically configured to implement with the processes, methods and/or instructions described herein may also be used.

In some embodiments, at least some functionality of the order processing device 1114 may be included in the pharmacy management device 1116. The order processing device 1114 may be in a client-server relationship with the pharmacy management device 1116, in a peer-to-peer relationship with the pharmacy management device 1116, or in a different type of relationship with the pharmacy management device 1116. The order processing device 1114 and/or the pharmacy management device 1116 may communicate directly (e.g., by utilizing a local storage) and/or through the network 1104 (e.g., by utilizing a cloud configuration or software as a service, etc.) with the storage 1110.

The user device 1108 is used by a device operator. The device operator may be a user (e.g., an employee, a contractor, a benefit member, a patient of the pharmacy, or the like) associated with the system 100. Other device operators may also operate the user device 1108. In some embodiments, the user device 1108 may enable the device operator to attend to pharmacy operations in a convenient manner (e.g., remote from a pharmacy). In some embodiments, the user device 1108 may enable the device operator to receive information about pharmacy processes, prescription drug fulfillment status, and the like.

The user device 1108 may be a stand-alone device that solely provides at least some of the functionality of the methods and systems or may be a multi-use device that has functionality outside off analysis of the methods and systems. In some embodiments, the computing system may include a mobile computing device. For example, the user device 1108 may include a mobile electronic device, such as an iPhone or iPad by Apple, Inc., and mobile electronic devices powered by Android by Google, Inc. The user device 108 may also include other computing devices, such as desktop computing devices, notebook computing devices, netbook computing devices, gaming devices, and the like. Other types of electronic devices may also be used. The user device 1108 running an application becomes a dedicated device when executing the application.

The storage device 1110 may include: a non-transitory storage (e.g., memory, hard disk, CD-ROM, and the like) in communication with the benefit manager device 1102, the pharmacy device 106, and/or the user device 108 directly and/or over the network 1104. The non-transitory storage may store order data 1118, member 1120, claims data 1122, drug data 1124, prescription data 1126, and/or plan sponsor 1128. Further, the system 1100 may include additional devices, which may communicate with each other directly or over the network 1104.

The order data 1118 may be related to a prescription order. The order data may include the type of the prescription drug (e.g., drug name and strength) and quantity of the prescription drug. The order data 1118 may also include data used for completion of the prescription, such as prescription materials and/or the type and/or size of container in which the drug is dispensed or in which is requested to be dispensed. In general, prescription materials include an electronic copy of information regarding the prescription drug for inclusion with or otherwise provided (e.g., via email) in conjunction with the fulfilled prescription. The prescription materials may include electronic information regarding drug interaction warnings, recommended usage possible side effects, expiration date, date of prescribing, or the like. The order data 1118 may be used by the pharmacy to fulfill a pharmacy order.

In some embodiments, the order data 1118 includes verification information associated with fulfillment of the prescription in the pharmacy. For example, the order data 1118 may include videos and/or images taken of (i) the prescription drug prior to dispensing, during dispensing, and/or after dispensing, (ii) the prescription container (e.g., a prescription bottle and sealing lid, prescription packaging, and the like) used to contain the prescription drug prior to dispensing, during dispensing, and/or after dispensing, (iii) the packaging and/or packaging materials used to ship or otherwise deliver the prescription drug prior to dispensing, during dispensing, and/or after dispensing, and/or (iv) the fulfillment process within the pharmacy. Other types of verification information, such as bar code data read from pallets, bins, trays, carts, and the like used to facilitate transportation of prescriptions within the pharmacy may also be stored as order data 1118.

The member data 1120 includes information regarding the members associated with the PBM. The information stored as member data 1120 may include personal information, personal health information, protected health information, fitness data, health data, web and mobile app activity, and the like. Examples of the member data 1120 include name, address, telephone number, e-mail address, prescription drug history, and the like. The member data 1120 may include a plan sponsor identifier that identifies the plan sponsor associated with the member and/or a member identifier that identifies the member to the plan sponsor. The member data 1120 may also include, by way of example, dispensation preferences such as type of label, type of cap, message preferences, language preferences, or the like.

The member data 1120 may be accessed by various devices in the pharmacy to obtain information utilized for fulfillment and shipping of prescription orders. In some embodiments, an external order processing device 1114 operated by or on behalf of a member may have access to at least a portion of the member data 1120 for review, verification, or other purposes.

In some embodiments, the member data 1120 may include information for persons who are patients of the pharmacy but are not members in a pharmacy benefit plan being provided by the PBM. For example, these patients may obtain drugs directly from the pharmacy, through a private label service offered by the pharmacy, or otherwise. In general, the use of the terms member (e.g., of a prescription drug benefit plan) and patient (e.g., of a pharmacy) may be used interchangeably in this disclosure.

The claims data 1122 includes information regarding pharmacy claims adjusted by the PBM under a drug benefit program provided by the PBM for one, or more than one, plan sponsor. In general, the claims data 1122 includes an identification of the client that sponsors the drug benefit program under which the claim is made, and/or the member that purchased the prescription drug giving rise to the claim, the prescription drug that was filled by the pharmacy (e.g., the national drug code number), the dispensing date, generic indicator, GPI number, medication class, the cost of the prescription drug provided under the drug benefit program, the copay/coinsurance amount, rebate information, and/or member eligibility, and the like. Additional information may be included.

In some embodiments, other types of claims beyond prescription drug claims may be stored in the claims data 1122. For example, medical claims, dental claims, wellness claims, or other types of health care-related claims for members may be stored as a portion of the claims data.

In some embodiments, the claims data 1122 includes claims that identify the members with whom the claims are associated. In some embodiments, the claims data 1122 includes claims that have been de-identified (e.g., associated with a unique identifier but not with a particular, identifiable member), aggregated, and/or otherwise processed.

The drug data 1124 may include drug name (e.g., technical name and/or common name), other names by which the drug is known by, active ingredients, an image of the drug (e.g., in pill form), and the like. The drug data 1124 may include information associated with a single medication or multiple medications.

The prescription data 1126 may include information regarding prescriptions that may be issued by prescribers on behalf of patients, who may be members of the pharmacy benefit plan, for example to be filled by a pharmacy. Examples of the prescription data 1126 include patient names, medication or treatment (such as lab tests), dosing information, and the like. The prescriptions may be electronic prescriptions, paper prescriptions that have been scanned, or otherwise. In some embodiments, the dosing information reflects a frequency of use (e.g., once a day, twice a day, before each meal, etc.) and a duration of use (e.g., a few days, a week, a few weeks, a month, etc.).

In some embodiments, the order data 1118 may be linked to associated member data 1120, claims data 1122, drug data 1124, and/or prescription data 1126.

The plan sponsor data 1128 includes information regarding the plan sponsors of the PBM. Examples of the plan sponsor data 1128 include company name, company address, contact name, contact telephone number, contact e-mail address, and the like.

Figure 12:
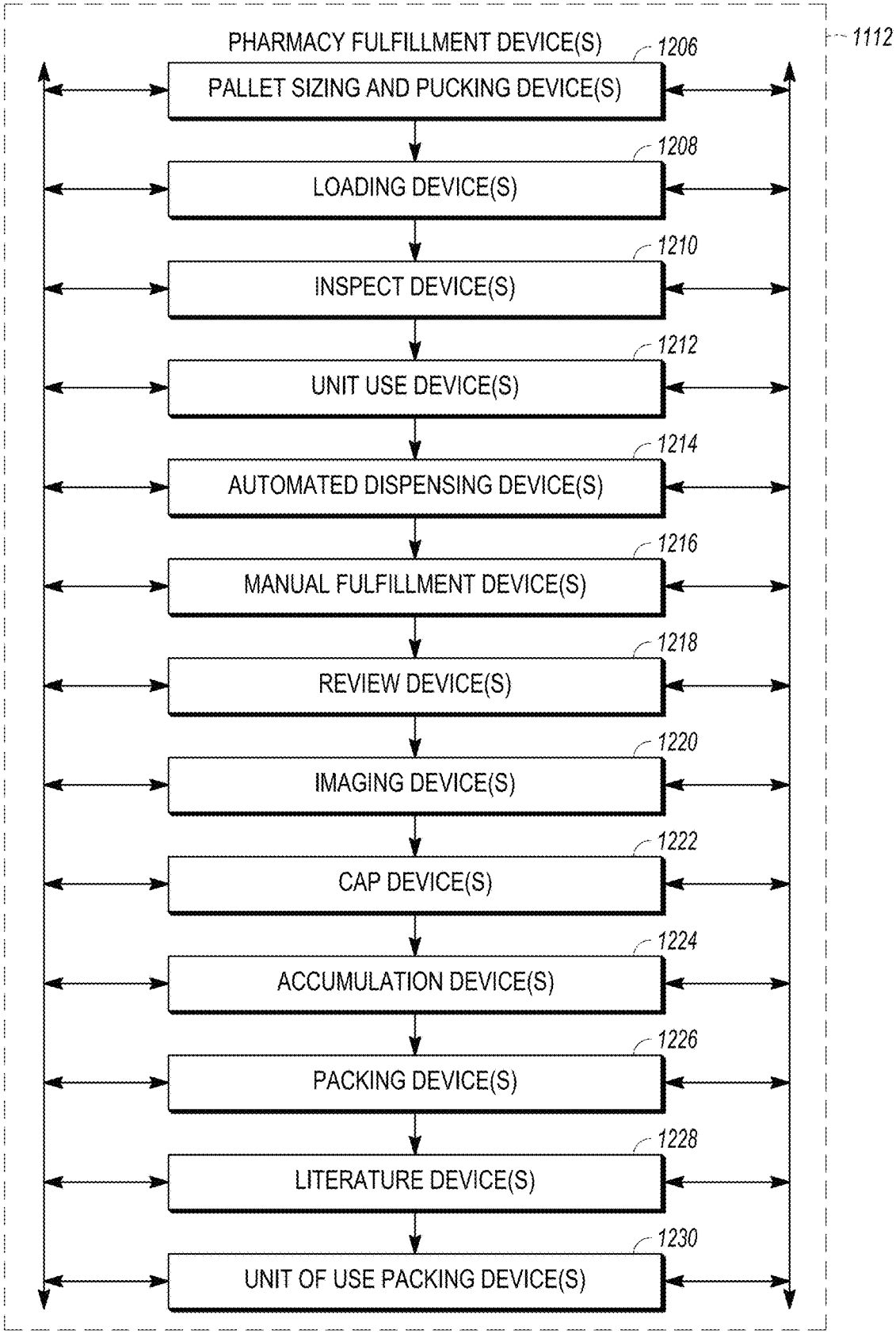
FIG. 12 is a block diagram of a pharmacy fulfillment device that may be deployed with a medication filling assembly system, in accordance with the disclosed embodiments.

FIG. 12 is a block diagram of a pharmacy fulfillment device 1112 that may be deployed with a medication filling assembly system (reference number 1100, FIG. 11), in accordance with the disclosed embodiments. The pharmacy fulfillment device 1112 may be used to process and fulfill prescriptions and prescription orders. After fulfillment, the fulfilled prescriptions are packed for shipping.

The pharmacy fulfillment device 1112 may include devices in communication with the benefit manager device, the order processing device 1114, and/or the non-transitory storage 1110, directly or over the network 1104. Specifically, the pharmacy fulfillment device 1112 may include pallet sizing and pucking device(s); loading device(s) 1208; inspect device(s) 1210, unit of use device(s) 1212, automated dispensing device(s) 1214, manual fulfillment device(s) 1216, review device(s) 1218, imaging device(s) 1220, cap device(s) 1222, accumulation device(s) 1224, literature device(s) 1228, packing device(s) 1226, and unit of use packing device(s) 1230. Further, the pharmacy fulfillment device 1112 may include additional devices, which may communicate with each other directly or over the network 1104.

In some embodiments, operations performed by one or more of these devices 1206-1230 may be performed sequentially, or in parallel with the operations of devices as may be coordinated by the order processing device 1114. In some embodiments, the order processing device 1114 tracks a prescription with the pharmacy based on operations performed by one or more than one of the devices 1206-1230.

In some embodiments, the pharmacy fulfillment device 1112 may transport prescription drug containers, for example, between more than one of the devices 1206-1230 in a high volume fulfillment center, by use of pallets. The pallet sizing and pucking device 1206 may configure pucks in a pallet. A pallet may be a transport structure for a number of prescription containers, and may include a number of cavities. A puck may be placed in one or more than one of the cavities in a pallet by the pallet sizing and pucking device 1206. The puck may include a receptacle sized and shaped to receive a prescription container. Such containers may be supported by the pucks during carriage in the pallet. Different pucks may have differently sized and shaped receptacles to accommodate containers of differing sizes, as may be appropriate for different prescriptions.

The arrangement of pucks in a pallet may be determined by the order processing device 1114 based on prescriptions that the order processing device 1114 decides to launch. The arrangement logic may be implemented directly in the pallet sizing and pucking device 1206. Once a prescription is set to be launched, a puck suitable for the appropriate size of container for that prescription may be positioned in a pallet by a robotic arm or pickers. The pallet sizing and pucking device 1206 may launch a pallet once pucks have been configured in the pallet.

The loading device 1208 may load prescription containers into the pucks on a pallet by a robotic arm, a pick and place mechanism, or the like. In one embodiment, the loading device 1208 has robotic arms or pickers to grasp a prescription container and move it to and from a pallet or to and from a puck. The loading device may also print a label that is appropriate for a container that is to be loaded onto the pallet and apply the label to the container. The pallet may be located on a conveyor assembly during these operations (e.g., at the high volume fulfillment center or the like).

The inspect device 1210 may verify that containers in a pallet are correctly labeled and in the correct spot on the pallet. The inspect device 1210 may scan the label on one or more than one container on the pallet. Labels of containers may be scanned or imaged in full or in part by the inspect device 1210. Such imaging may occur after the container has been lifted out of its puck by a robotic arm, picker, or the like, or may be otherwise scanned or imaged while retained in the puck. In some embodiments, images and/or video captured by the inspect device may be stored in the storage device as a portion of the order data 1118.

The unit of use device 1212 may temporarily store, monitor, label, and/or dispense unit of use products. In general, unit of use products are prescription drug products that may be delivered to a patient or member without being repackaged at the pharmacy. These products may include pills in a container, pills in a blister pack, inhalers, liquids in a spray or other dispensing container, and the like. Prescription drug products dispensed by the unit of use device 1212 may be packaged individually or collectively for shipping or may be shipped in combination with other prescription drugs dispensed by other devices (e.g., in the high volume fulfillment center).

At least some of the operations of the devices 1206-1230 may be directed by the order processing device 1114. For example, the manual fulfillment device 1216, the review device 1218, the automated dispensing device 1214, the packing device 1226, and/or another device may receive instructions provided by the order processing device.

The automated dispensing device 1214 may include one or more than one device that dispenses prescription drugs or pharmaceuticals into prescription containers in accordance with one or multiple prescription orders. In general, the automated dispensing device 1214 may include mechanical and electronic components with, in some embodiments, software and/or logic to facilitate pharmaceutical dispensing that would otherwise be performed in a manual fashion by a pharmacist and/or pharmacist technician. For example, the automated dispensing device 1214 may include high volume fillers (HVFs) that fill a number of prescription drug types at a rapid rate and blister pack machines that dispense and pack drugs into a blister pack. Prescription drugs dispensed by the automated dispensing devices 1214 may be packaged individually or collectively for shipping or may be shipped in combination with other prescription drugs dispensed by other devices in the high volume fulfillment center. The automated dispensing device 1214 may include a counter to count medications from a vibratory bowl that includes at least one shim for physically separating the pills to ensure an accurate pill count or tally, prior to packaging and shipping.

The manual fulfillment device 1216 may provide for manual fulfillment of prescriptions. For example, the manual fulfillment device 1216 may receive or obtain a container and enable fulfillment of the container by a pharmacist or pharmacy technician. In some embodiments, the manual fulfillment device 1216 provides the filled container to another device in the pharmacy fulfillment devices 1112 to be joined with other containers in a prescription order for a patient or member. In general, a manual fulfillment may include operations at least partially performed by a pharmacist or a pharmacy technician. For example, a person may retrieve a supply of the prescribed drug, may make an observation, may count out a prescribed quantity of drugs and place them into a prescription container, or the like. Some portions of the manual fulfillment process may be automated by use of a machine. For example, counting of capsules, tablets, or pills may be at least partially automated (e.g., through use of a pill counter or the like). Prescription drugs dispensed by the manual fulfillment device 1216 may be packaged individually or collectively for shipping or may be shipped in combination with other prescription drugs dispensed by other devices in the high volume fulfillment center.

The review device 1218 may process prescription containers to be reviewed by a pharmacist for proper pill count, exception handling, prescription verification, and the like. Fulfilled prescriptions may be manually reviewed and/or verified by a pharmacist, as may be required by state or local law. A pharmacist or other licensed pharmacy person who may dispense certain drugs in compliance with local and/or other laws may operate the review device 1218 and visually inspect a prescription container that has been filled with a prescription drug. The pharmacist may review, verify, and/or evaluate drug quantity, drug strength, and/or drug interaction concerns, or otherwise perform pharmacist services. The pharmacist may also handle containers which have been flagged as an exception, such as containers with unreadable labels, containers for which the associated prescription order has been cancelled, containers with defects, and the like. In an example embodiment, the manual review may be performed at the manual station.

The imaging device 1220 may image containers prior to filling and/or after they have been filled with pharmaceuticals. The imaging device 1220 may measure a fill height of the pharmaceuticals in the container based on the obtained image to determine if the container is filled to the correct height given the type of pharmaceutical and the number of pills in the prescription. Images of the pills in the container may also be obtained to detect the size of the pills themselves and markings thereon. The images may be transmitted to the order processing device 1114, and/or stored in the storage device 1110 as part of the order data 1118.

The cap device 1222 may be used to cap or otherwise seal a prescription container. In some embodiments, the cap device 1222 may secure a prescription container with a type of cap in accordance with a patient preference (e.g., a preference regarding child resistance, a preference regarding built-in adherence functionality, or the like), a plan sponsor preference, a prescriber preference, or the like. The cap device 1222 may also etch a message into the cap or otherwise associate a message into the cap, although this process may be performed by a different device in the high volume fulfillment center.

The accumulation device 1224 accumulates various containers of prescription devices in a prescription order. The accumulation device 1224 may accumulate prescription containers from various devices or areas of the pharmacy. For example, the accumulation device 1224 may accumulate prescription containers from the unit of use device 1212, the automated dispensing device 1214, the manual fulfillment device 1216, and the review device 1218, at the high volume fulfillment center. The accumulation device 1224 may be used to group the prescription containers prior to shipment to the member or otherwise.

The literature device 1228 prints, or otherwise generates, literature to include with prescription drug orders. The literature may be printed on multiple sheets of substrates, such as paper, coated paper, printable polymers, or combinations thereof. The literature printed by the literature device 1228 may include information required to accompany the prescription drugs included in a prescription order, relating to prescription drugs in the order, financial information associated with the order (e.g., an invoice or an account statement, or the like).

In some embodiments, the literature device 1228 folds or otherwise prepares the literature for inclusion with a prescription drug order (e.g., in a shipping container or the like). In some embodiments, the literature device 1228 that prints the literature may be separate from the literature device that prepares the literature for inclusion with a prescription order. The packing device 1226 packages a prescription order in preparation for shipping the order. The packing device 1226 may box, bag, or otherwise package the fulfilled prescription order for delivery. The packing device 226 may be a wrap seal device. A wrap seal device deployed as the packing device 1226 may be a wrap seal device. A wrap seal device deployed as the packing device 1226 may pause before an index; during the pause, one or more bottle, envelope or literature items have been placed within a vacuum pocket of the wrap seal device. After any bottle, envelope, or literature items have been placed in the pocket, the wrap seal device may index; specifically, the vacuum pocket may move forward. In an example embodiment, the forward movement is about the length of a bag (for example, between about 16 and 20 inches).

The packing device 1226 may further place inserts (e.g., literature or other papers) into the packaging received from the literature device 1228 or otherwise. For example, bulk prescription orders may be shipped in a box, while other prescription orders may be shipped in a bag which may be a wrap seal bag. The packing device 1226 may label the box or bag with an address and a recipient's name. The label may be printed and affixed to the bag or box, be printed directly onto the bag or box, or otherwise associated with the bag or box. The packing device 1226 may sort the box or bag for mailing in an efficient manner (e.g., sort by delivery address, sort by zip code, or the like). The packing device 1226 may label the box or bag with an address and a recipient's name. The label may be printed and affixed to the bag or box, be printed directly onto the bag or box, or otherwise associated with the bag or box. The packing device 1226 may sort the box or bag for mailing in an efficient manner (e.g., sort by delivery address, sort by zip code, or the like). The packing device 1226 may include ice or temperature sensitive elements for prescriptions which are to be kept within a temperature range during shipping in order to retain efficacy or otherwise. The ultimate package may then be shipped through postal mail, through a mail order delivery service that ships via ground and/or air (e.g., UPS®, FedEx®, or DHL®, or the like), through delivery service, through a local delivery service (e.g., a courier service), through a locker box at a shipping site (e.g., an Amazon® locker, library locker, a post office box, or the like) or otherwise.

The unit of use packing device 1230 packages a unit of use prescription order in preparation for shipping the order. The pharmacy fulfillment device 1112 in FIG. 12 may include single devices 1206-1230 or multiple devices 1206-1230 (e.g., depending upon implementation in a pharmacy). The devices 1206-1230 may be the same type or model of device or may be different device types or models. When multiple devices are present, the multiple devices may be of the same device type or models or may be a different device type or model. The types of devices 1206-1230 shown in FIG. 12 are example devices. In other configurations of the system 1100 of FIG. 11, lesser, additional, or different types of devices may be included.

Moreover, multiple devices may share processing and/or memory resources. The devices 1206-1230 may be located in the same area or in different locations. For example, the devices 1206-1230 may be located in a building or a set of adjoining buildings. The devices 1206-1230 may be interconnected (e.g., by conveyors), networked, and/or otherwise in contact with one another or integrated with one another (e.g., at the high volume fulfillment center). In addition, the functionality of a device may be split among a number of discrete devices and/or combined with other devices.

Figure 13:
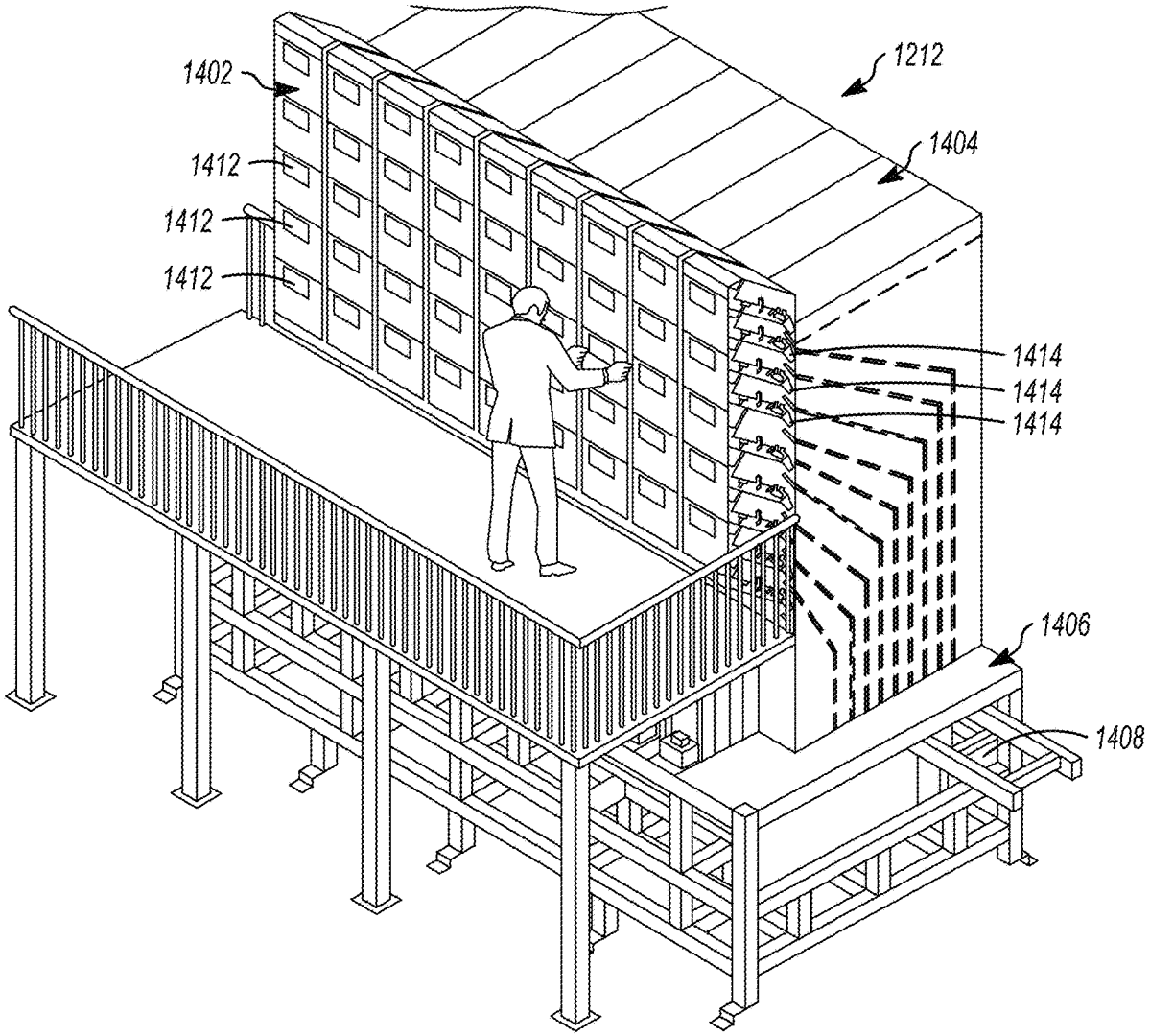
FIG. 13 is a perspective view of an automated dispensing device that may be deployed within a medication filling assembly system, in accordance with the disclosed embodiments.

FIG. 13 is a perspective view of an automated dispensing device that may be deployed within a medication filling assembly system (reference 1100 of FIG. 11), in accordance with the disclosed embodiments. FIG. 13 illustrates the automated dispensing device 1212, according to an example embodiment. The automated dispensing device 1212 enables dispensing of a number of different types of pharmaceuticals in an automated or semiautomatic manner. The automated dispensing device 1212 includes a filling cabinet 1402, a prefill assembly 1404, and a pallet system 1406 which includes a pallet conveyor 1408. The filling cabinet 1402 stores pharmaceuticals to be dispensed into containers via the prefill assembly 1404 and dispenses measured quantities of pharmaceuticals into the prefill assembly 1404. The prefill assembly 1404 stores the measured quantities of pharmaceuticals and dispenses the measured quantities of pharmaceuticals received from the filling cabinet 1402 into containers on the pallet while the pallet is positioned in the pallet system 1406. The pallet conveyor 1408 can transport the pallets through some or all of the devices within the pharmacy fulfillment device 1112 (shown in FIG. 12).

In certain embodiments, in operation, the pallet conveyor 1408 automatically brings a pallet with one or more containers to the pallet system 1406. The pallet system 1406 automatically guides the pallet to a location directly beneath the prefill assembly 1404 so that the measured quantity of pharmaceuticals can be dispensed into one of the containers found on the pallet. This process can be repeated to dispense multiple measured quantities of the same or different pharmaceuticals into different containers on the pallet. The pallet conveyor 1408 may be a chain conveyor or a belt driven conveyor, e.g., a belted Bosch TS2 belt-driven conveyor. In some embodiments, the pallet conveyor 1408 is a low friction, high speed conveyor. Although pallets are generally described herein as employed to move a group of containers through the system (reference number 1100, FIG. 11) or within the automated dispensing device 1212, trays or other types of carriers and any suitable type of container management system may be employed to individually or as a group move the containers through the system (reference number 1100, FIG. 11) or within the automated dispensing device 1212.

In the exemplary embodiment, the filling cabinet 1402 is physically adjacent to the prefill assembly 1404, and the prefill assembly 1404 is physically located directly above the pallet system 1406. For example, the filling cabinet 1402 and prefill assembly 1404 may be located on a second floor (e.g., in a building), and the pallet system 1406 may be located on a first floor below the second floor. These components of the automated dispensing device 1212 may be otherwise positioned, e.g., in a position to utilize gravity to move pharmaceuticals from the filling cabinet 1402 to the prefill assembly 1404 and then to the containers on the pallet. For example, some portion of the filling cabinet 1402 may extend below the second floor.

In the exemplary embodiment, the filling cabinet 1402 includes multiple cells 1412 arranged in a grid-like pattern with a plurality of columns and a plurality of rows. Specifically, in the exemplary embodiment, the filling cabinet 1402 has ten columns and nine rows for a total of ninety cells 1412. In some embodiments, the filling cabinet 1402 has either more or fewer rows and/or columns of cells 1412. The various cells 1412 may each be adapted to similar or different pharmaceuticals, e.g., pills, tablets, or capsules. For example, in some embodiments, a commonly prescribed pharmaceutical may occupy more than one cell 1412. The cells 1412 are be adapted to receive inserts 1414 which can hold the pharmaceuticals then automatically dispense the pharmaceuticals into the prefill assembly 1404.

Dispensing can include counting each pharmaceutical item, staging the counted group of a plurality of pharmaceutical items and then release the group of items into the appropriate container. As described herein, counting is performed by a pill counter device that includes a vibratory bowl and at least one shim that physically separates the pills for counting purposes. In the exemplary embodiment, the inserts 1414 can be pulled out of the cells 1412 like drawers. In other embodiments, the inserts 1416 may be permanently located in the cells 1412. In the exemplary embodiment, only a single filling cabinet 1402 with a single prefill assembly 1404 is shown. However, in some embodiments, two opposing filing cabinets 1402 and two opposing prefill assemblies 1404 may be positioned over the same pallet system 1404.

In the exemplary embodiment, each insert 1414 has a face plate with a door which must be unlocked to open. The door may be adapted to unlock pursuant to a process that mitigates risk of unauthorized access to the pharmaceuticals within the insert 1414 and/or to mitigate risks that unintended pharmaceuticals will be added to the insert 1414. For example, in the exemplary embodiment, the door of each cell 1412 will unlock when identifying information associated with a pharmaceutical container is detected (e.g., by a pharmacist using a hand-held scanning device to read a bar code or other computer-readable element on the pharmaceutical container) that matches identifying information associated with the cell 1412 (e.g., by a pharmacist using a hand-held scanning device to read a bar code or other computer-readable element on the face plate of the insert 1414) and information about the pharmacist who fills the cell 1412 (e.g., by a pharmacist using a hand-held scanning device to read a bar code or other computer-readable element on the pharmacist's badge). The inserts 1414 may be otherwise accessed to receive pharmaceuticals to be held and dispensed.

Figure 14:
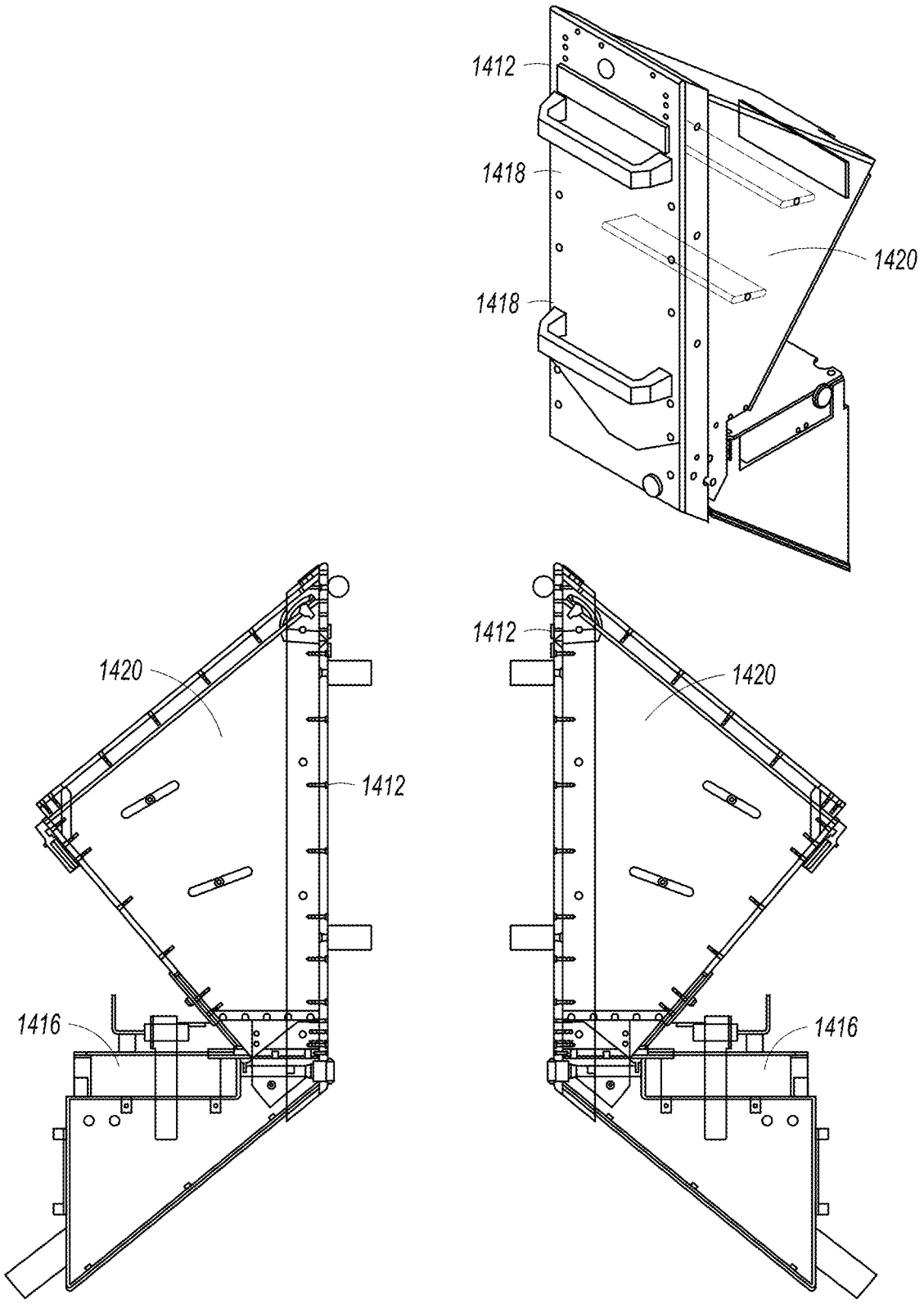
FIG. 14 is multiple views of a solid counting device implemented as part of a medication filling assembly system.

FIG. 14 is multiple views of a solid counting device implemented as part of a medication filling assembly system (reference 1100 of FIG. 11). Referring now to FIG. 14, each cell 1412 has a pill counter with an output which feeds the pharmaceuticals (e.g., a plurality of the same item) contained therein into the prefill assembly 1404 (shown in FIG. 13). The feeding includes a specific count of pharmaceutical items being released from the cell 1412.

The pill counter includes a vibratory bowl 1416 and at least one internally positioned shim (not shown) for performing physical separation of discrete solids. A primary shim may be positioned against an internal edge of the vibratory bowl 1416, and the primary shim is operable to use an included projection to physically separate pills that are traveling side-by-side inside the vibratory bowl 1416 as the pills travel into an exit channel leading to an exit opening. In some embodiments, a secondary shim may be positioned above the primary shim at a height greater than one pill height but less than the height of two pills. The secondary shim extends horizontally into the exit channel and is operable to physically separate pills that are "stacked", where a second pill is disposed upon the top of a first pill.

As shown in FIG. 13, the prefill assembly 1404 includes a plurality of doors 1418 (two being shown in FIG. 14). Each of the doors 1418 includes a guiding system for guiding the pharmaceuticals dispensed from the respective cells 1412 into the appropriate containers on the pallet in the pallet system 1406, after the pill counting process is completed.

Techniques and technologies may be described herein in terms of functional and/or logical block components, and with reference to symbolic representations of operations, processing tasks, and functions that may be performed by various computing components or devices. Such operations, tasks, and functions are sometimes referred to as being computer-executed, computerized, software-implemented, or computer-implemented. In practice, one or more processor devices can carry out the described operations, tasks, and functions by manipulating electrical signals representing data bits at memory locations in the system memory, as well as other processing of signals. The memory locations where data bits are maintained are physical locations that have particular electrical, magnetic, optical, or organic properties corresponding to the data bits. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

The preceding description refers to elements or nodes or features being "connected" or "coupled" together. As used herein, unless expressly stated otherwise, "coupled" means that one element/node/feature is directly or indirectly joined to (or directly or indirectly communicates with) another element/node/feature, and not necessarily mechanically. Likewise, unless expressly stated otherwise, "connected" means that one element/node/feature is directly joined to (or directly communicates with) another element/node/feature, and not necessarily mechanically. Thus, although the schematic shown in FIG. 1 depicts one exemplary arrangement of elements, additional intervening elements, devices, features, or components may be present in an embodiment of the depicted subject matter.

In addition, certain terminology may also be used in the preceding description for the purpose of reference only, and thus are not intended to be limiting. For example, terms such as "upper", "lower", "above", and "below" refer to directions in the drawings to which reference is made. Terms such as "front", "back", "rear", "side", "outboard", and "inboard" describe the orientation and/or location of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context.

For the sake of brevity, conventional techniques related to signal processing, data transmission, signaling, network control, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

Some of the functional units described in this specification have been referred to as "modules" in order to more particularly emphasize their implementation independence. For example, functionality referred to herein as a module may be implemented wholly, or partially, as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices, or the like. Modules may also be implemented in software for execution by various types of processors. An identified module of executable code may, for instance, comprise one or more physical or logical modules of computer instructions that may, for instance, be organized as an object, procedure, or function. Nevertheless, the executables of an identified module need not be physically located together, but may comprise disparate instructions stored in different locations that, when joined logically together, comprise the module and achieve the stated purpose for the module. Indeed, a module of executable code may be a single instruction, or many instructions, and may even be distributed over several different code segments, among different programs, and across several memory devices. Similarly, operational data may be embodied in any suitable form and organized within any suitable type of data structure. The operational data may be collected as a single data set, or may be distributed over different locations including over different storage devices, and may exist, at least partially, merely as electronic signals on a system or network.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A shim for a solid counting device, the shim comprising:

a first end, including a first width and a projection extending in a lateral direction;

a second end, including a second width greater than the first width; and an elongated body extending in a longitudinal dimension from the first end to the second end, the first width, the second width, and the projection configured to prevent more than one of a plurality of solids simultaneously traveling into an exit channel of the solid counting device, wherein the shim includes an outer convex surface extending along a constant radius and an inner concave surface extending along an inner radius that shortens from the first end to the second end.

2. The shim of claim 1, wherein the first end includes an additional projection spaced from the projection in a direction of travel of the one of the plurality of solids in the exit channel; and wherein the first width, the second width, the projection, and the additional projection are configured to prevent the more than one of the plurality of solids traveling into the exit channel of the vibratory bowl.

3. The shim of claim 1, wherein the projection comprises a semi-cylindrical shape including a center point coincident with an inner surface of the shim; and wherein the first width, the second width, and the semi-cylindrical shape are configured to prevent the more than one of the plurality of solids traveling into the exit channel of the solid counting device.

4. The shim of claim 1, wherein the projection is semi-cylindrical with an outer surface that is coincident with an edge of the first end.

5. The shim of claim 1, wherein the projection comprises a semi-cylindrical shape extending an entire height of the shim.

6. The shim of claim 1, wherein the outer convex surface positioned adjacent to an inner surface of a vibratory bowl, to prevent the more than one of the plurality of solids from traveling into the exit channel that includes the inner surface where the shim is positioned; and wherein the solid counting device includes the vibratory bowl.

7. The shim of claim 6, wherein the shim further comprises:

a fastener device configured to secure the shim to the inner surface of the vibratory bowl and on a ramp of the exit channel, to prevent travel of a solid beneath the shim.

8. The shim of claim 1, wherein the projection extends outward from the inner concave surface of the shim; and wherein the inner concave surface contacts the plurality of solids to be counted.

9. The shim of claim 1, wherein the shim is positioned inside the exit channel of a vibratory bowl, to prevent the more than one of the plurality of solids from traveling into the exit channel; and wherein the solid counting device includes the vibratory bowl.

10. The shim of claim 1, wherein the elongated body narrows in a lateral dimension from the second end to the first end; and wherein the first width comprises a diameter of the projection extending from the first end, the diameter being less than the second width.

11. The shim of claim 10, wherein the first width and the second width comprise proportional values associated with a particular type of a solid to be counted; and wherein the plurality of solids include the solid.

12. The shim of claim 1, wherein the elongated body is unitary with a varying width and includes the first end, the second end, the projection extending inwardly toward a solids travel path, the outer convex surface configured to abut an interior wall of a solids counter, and the inner concave surface configured to contact solids pills along the solids travel path.

13. A system for counting solids, the system comprising:

a vibratory bowl comprising at least an inner bowl surface and an exit opening, the vibratory bowl configured to:

generate motion of a plurality of solids; and dispense individual ones of the plurality of solids, via the exit opening, for counting the plurality of solids; and a shim positioned inside an exit channel extending from the exit opening of the vibratory bowl, the shim comprising:

a first end, including a first width and a projection extending in a lateral direction;

a second end, including a second width greater than the first width; and an elongated body extending in a longitudinal dimension from the first end to the second end, the first width, the second width, and the projection configured to prevent more than one of the plurality of solids simultaneously traveling into an exit channel of the vibratory bowl.

14. The system of claim 13, wherein the first end includes an additional projection spaced from the projection in a direction of travel of the one of the plurality of solids in the exit channel; and wherein the first width, the second width, the projection, and the additional projection are configured to prevent the more than one of the plurality of solids traveling into the exit channel of the vibratory bowl.

15. The system of claim 13, wherein the projection comprises a semi-cylindrical shape including a center point coincident with an inner surface of the shim; and wherein the first width, the second width, and the semi-cylindrical shape are configured to prevent the more than one of the plurality of solids traveling into the exit channel of the vibratory bowl.

16. The system of claim 13, wherein the shim further comprises:

a fastener device configured to secure the shim to the inner surface of the vibratory bowl and on a ramp of the exit channel, to prevent travel of a solid beneath the shim.

17. The system of claim 13, wherein the elongated body narrows in a lateral dimension from the second end to the first end; and wherein the first width comprises a diameter of the projection extending from the first end, the diameter being less than the second width.

18. The system of claim 13, wherein the first width and the second width comprise proportional values associated with a particular type of a solid to be counted; and wherein the plurality of solids include the solid.

19. The system of claim 13, wherein the shim further comprises:

an inner concave surface positioned to contact the plurality of solids to be counted, wherein the projection extends outward from an inner concave surface of the shim; and an outer convex surface positioned adjacent to an inner surface of a vibratory bowl, to prevent the more than one of the plurality of solids from traveling into the exit channel that includes the inner surface where the shim is positioned.

20. The shim of claim 19, wherein the outer convex surface extends along a constant radius; and wherein the inner concave surface extends along an inner radius that shortens from the first end to the second end.

21. A method for counting solids using a solid counting device, the method comprising:

receiving a plurality of solids to be counted, by a vibratory bowl comprising at least an inner bowl surface, an exit opening, and a channel extending from the exit opening around an edge of the vibratory bowl;

generating motion to shuffle the plurality of solids toward the channel, by the vibratory bowl;

separating one of the plurality of solids entering the channel connected to the exit opening, by a shim comprising an elongated body narrowing from a second end to a first end having a projection extending in a lateral direction, the shim being positioned in the channel; and dispensing the one of the plurality of solids via the exit opening, using the motion, the channel, and the shim.

22. The method of claim 21, further comprising:

performing a continuous process, by:

generating the motion continuously during the process of counting the plurality of solids, by the vibratory bowl, to shuffle the plurality of solids toward the channel continuously;

separating individual ones of the plurality of solids entering the channel, by the shim; and dispensing the plurality of solids, individually via the exit opening, using the motion, the channel, and the shim.

23. The method of claim 21, wherein separating the one of the plurality of solids entering the channel connected to the exit opening, further comprises:

receiving a subset of the plurality of solids, by the channel, during generation of the motion, wherein the subset includes the one and a second one of the plurality of solids;

permitting the one of the plurality of solids to progressively travel toward the exit opening using the channel, by the shim; and impeding a path of the second one, by the shim, based on a size of the one and the second one, a projection width, and a channel width.

24. The method of claim 23, wherein impeding the path of the second one further comprises:

partially obstructing the channel using at least one physical characteristic of the shim, the at least one physical characteristic including the projection width and a width of the first end; and preventing the second one from entering the channel simultaneously with the one of the plurality of solids, based on partially obstructing the channel and the size of the one and the second one.

25. The method of claim 23, wherein impeding the path of the second one further comprises:

partially obstructing the exit opening using at least one physical characteristic of the shim, the at least one physical characteristic including a width of the second end and a position of the shim; and preventing the second one from entering the exit opening simultaneously with the one of the plurality of solids, based on partially obstructing the exit opening and the size of the one and the second one.

26. A shim for a solid counting device, the shim comprising:

a first end, including a first width and a projection extending in a lateral direction;

a second end, including a second width greater than the first width;

an elongated body extending in a longitudinal dimension from the first end to the second end, the first width, the second width, and the projection configured to prevent more than one of a plurality of solids simultaneously traveling into an exit channel of the solid counting device; and a fastener device configured to secure the shim to an inner surface of the vibratory bowl and on a ramp of the exit channel, to prevent travel of a solid beneath the shim.

27. The shim of claim 26, wherein the first width and the second width comprise proportional values associated with a particular type of a solid to be counted; and wherein the plurality of solids include the solid.

28. The shim of claim 26, wherein an outer convex surface of the elongated body is positioned adjacent to an inner surface of a vibratory bowl to prevent the more than one of the plurality of solids from traveling into the exit channel that includes the inner surface where the shim is positioned.

29. The shim of claim 26, wherein the projection comprises a semi-cylindrical shape extending an entire height of the shim.

30. The shim of claim 26, wherein the projection is semi-cylindrical with an outer surface that is coincident with an edge of the first end.

* * * * *